US005842300A

United States Patent [19]

Cheshelski et al.

[11] Patent Number: 5,842,300

[45] Date of Patent: Dec. 1, 1998

[54] RETROFITTABLE LASER AND RECOIL SYSTEM FOR A FIREARM

[75] Inventors: Ben Cheshelski, Melbourne; Edward Lee Caraway, Indialantic, both of Fla.; Andrew R. Gazaway, Alpharetta, Ga.; Michael F. Belgin, Indialantic, Fla.

[73] Assignee: FSS, Inc., Suwanee, Ga.

[21] Appl. No.: 711,173

[22] Filed: Sep. 9, 1996

[51] Int. Cl.[6] ..... F41G 1/34

[52] U.S. Cl. ..... 42/103; 42/7; 42/50

[58] Field of Search ..... 42/103, 7, 50; 89/41.06; 33/233; 359/131; 362/110

[56] References Cited

U.S. PATENT DOCUMENTS

| | | | |
|---|---|---|---|
| 3,526,972 | 9/1970 | Sumpf | 35/25 |
| 3,898,747 | 8/1975 | Marshall | 35/25 |
| 3,938,262 | 2/1976 | Dye | 35/25 |
| 3,995,376 | 12/1976 | Kimble et al. | 35/25 |
| 3,999,321 | 12/1976 | Musgrave | 42/71 P |
| 4,273,536 | 6/1981 | Wick | 434/14 |
| 4,777,754 | 10/1988 | Reynolds, Jr. | 42/103 |
| 4,830,617 | 5/1989 | Hancox et al. | 434/21 |
| 4,856,218 | 8/1989 | Reynolds, Jr. | 42/103 |
| 5,119,576 | 6/1992 | Erning | 42/103 |
| 5,272,828 | 12/1993 | Petrick et al. | 42/84 |
| 5,299,375 | 4/1994 | Thvmmel et al. | 42/103 |
| 5,351,429 | 10/1994 | Ford | 42/103 |
| 5,365,669 | 11/1994 | Rustick | 33/234 |
| 5,435,091 | 7/1995 | Toole et al. | 42/103 |

*Primary Examiner*—Charles T. Jordan
*Assistant Examiner*—Meena Chelliah
*Attorney, Agent, or Firm*—H. Mitchell Hanegan

[57] ABSTRACT

The present invention relates to a retrofittable laser system (10) utilizing miniaturized components which are insertable into a pistol barrel (24B) of a pistol (24) which emits a laser module light pulse (12C) when a pistol firing trigger (24F) activates a pistol firing pin (24E). The pistol (24) further comprises a pistol housing (24A) and a pistol ammunition chamber (24D). The retrofittable laser system (10) comprises a laser module (12) which comprises at least one laser module pin (12A). The laser module (12) further comprises a laser module diode (12E) having a laser module diode driver circuit (12EA) electronically connected to the at least one laser module pin (12A). The laser module (12) further comprises a laser module graded index optics (12D) integrally associated with the laser module diode (12E). The retrofittable laser system (10) further comprises a processor module (14) which comprises at least one module pin receptacle which is complimentary to the at least one laser module pin (12A) forming an electrical connection when inserted therein and at least one processor module pin. The retrofittable laser system (10) further comprises a piezo module (16) which comprises at least one piezo module pin receptacle (16B) which is complimentary to the at least one processor module pin forming an electrical connection when inserted therein and at least one piezo module pin (16A) and a piezo module switch (16D) which is activatable when hit by the pistol firing pin (24E). The retrofittable laser system (10) further comprises a power module (18) which comprises at least one power module electronic connector pin receptacle which is complimentary to the at least one piezo module pin (16A)forming an electrical connection when inserted therein.

14 Claims, 11 Drawing Sheets

RETROFITTABLE LASER AND RECOIL SYSTEM FOR A FIREARM

BACKGROUND OF THE INVENTION

1. Field of the Invention

The present invention relates to a retrofittable laser system which a user can convert his/her own personal firearm to a training firearm simulator incapable of firing live ammunition and then convert back to the original operational firearm configuration. More particularly, the present invention relates to retrofittable laser system which is integrally mounted within a standard barrel of the laser simulator barrel and electronic means firearm having power mountable in a retrofittable ammunition magazine. An optional recoil means may also be incorporated into the retrofittable barrel and/or retrofittable ammunition magazine.

2. Description of the Prior Art

Many law enforcement agencies and military organizations throughout the world utilize interactive training systems coupled with firearm simulators to train personnel in the proper use, judgement, safety, and accuracy in the utilization of a firearm in performing their responsibilities and duties. The weapons simulator industries provides several types of video graphic, computer enhanced training system to provide law enforcement agencies and military organizations with the capabilities to train individuals and teams of individuals to respond to various scenarios. They can evaluate the individual and the team and its members in terms of compliance to appropriate procedures and compliance to local, state, federal, and constitutional laws or international law as the case warrants. These training systems typically utilize a firearm simulator. For example, a near replica or modification to a handgun replaces the individual's "real" service weapon. The replica handgun generally does not have the same "feel", balance, and/or sighting features of the individuals service weapon. In addition, the using agency must purchase these dedicated "replica" weapons in addition to the service weapons.

These replica or firearms simulators fire a laser pulse which impacts a screen on which the scenario is projected. A detector detects the reflected laser energy at the point on the screen from which the laser energy is reflected and is correlated to the X and Y axis of the screen surface.

A computer then correlates the position of the laser shot impact on the screen to the position of the video graphic character. Having computed the correlation, the computer displays appropriate information concerning the affects on the alleged perpetrator.

In one case, up to 4 individuals can be trained on a training simulator at the same time. The firearms simulators for each of the 4 weapons have individual codes assigned to each firearms simulator and the code is transmitted in the pulse width modulation laser beam when the firearm simulator is fired.

Focusing on the field of the present invention, there are several companies which manufacturer firearms simulators that are compatible with the OEM simulator training system.

In the past, most firearms training system have utilized dedicated firearm simulators that are designed for use on a specific simulator. This situation was necessitated by the use of different types and makes of detectors and the independent design goals within the training system itself.

The firearm simulator was designed to function with that specific training system and, normally, the firearm simulator was provided by the same company as designer/manufacturer/distributor of the training system in order to assure compatibility.

Obviously, no firearm training system can operate without the appropriate firearm training device (simulator). These firearm simulators typically incorporate radiation sources such as lasers, are powered by battery(s), are controlled by signal processors and microprocessors, and are activated by some sort of switching device when the trigger is "pulled". These firearm simulators are normally made by converting "real" firearms (those that fire live ammunition) or replica firearms into dedicated simulators since the design implementation severely modifies and/or replaces original OEM parts. An example of this type of non-reversible weapon simulator is that described in U.S. Pat. No. 5,119,576. The patented invention requires the machining of various parts of a live ammunition firing weapon to house the patented invention. Usually, this machining results in the machining of a weapon that cost more than $500 and the resultant, machined weapon simulator cannot be returned to the original live ammunition firing weapon without significant, additional cost. The patented invention is also restricted to handguns while the present invention can be generally used in virtually all classes and types of weapons. Other such implementation result in respective weapon simulators being returned to a safe firing configuration only through major rebuild and/or reconstruction of parts to OEM specifications at significantly increased cost and time.

Another approach to firearm simulators utilized a laser also powered by batteries, controlled by a timing device, but activated by a piezo type system that senses the hammer drop of the firearm fitted with the device. This approach required the unit (an obtrusive, bulk, and disproportionate mass) to be attached to the firearm by use of a barrel insertion rod of various lengths and diameters, based on barrel length and caliber. "O" rings were used to secure the rod in the barrel. However, this design required both a sensitivity adjustment and alignment of the laser impact point to the sights of the firearm. Additional sighting and alignment problems occurred when the firearm was holstered, stored, or handled in anything but a gentle manner since only the "O" rings secured the device to the firearm. While this system was acceptable for use in accuracy training, where handling and movement were minimized, it was not very acceptable for the rigors of interactive training.

Many law enforcement and military agencies throughout the world utilize interactive training systems coupled with firearm simulators to train personnel in the proper use, judgement, safety, and accuracy in utilizing firearms in performance of their responsibilities. The present invention relates to these interactive firearm training systems wherein a firearms simulator is required to represent a "real" firearm allowing the user to engage in the use of the training system for electronic/video interactive judgmental training. The simulator training systems have been shown to minimize training cost, emphasize and improve safety, and provide more concentrated and effective firearms situational training.

Numerous innovations for "laser" type firearms simulators have been provided in the prior art that are described as follows. Even though these innovations may be suitable for the specific individual purposes to which they address, they differ from the present invention as hereinafter contrasted.

In U.S. Pat. No. 4,761,907 to Carlo De Bernardini teaches a shock detector controlling the release of the laser as well as a part limited the stroke of the percussion system to a value such that its impact on this part will be sufficient to release the laser through the intermediate of the detector but insufficient to cause vibrations of the weapon leading to oscillations of the laser beam.

The present invention differs from the patented invention because the patented invention uses a breech insert containing a laser that is fired by impact of the hammer of the weapon on the patented invention. The present invention comprises a replacement of the entire barrel of the weapon with one containing a laser module(s) and processor module (s). The present invention has considerable advantage over the patented invention in that the laser of the present invention is pre-aligned to the barrel whereas the patented invention has no alignment means other than wedging it to the breech of the weapon.

In U.S. Pat. No. 4,313,272 by inventor, John W. Matthews, teaches a laser for assisting the aiming of a firearm and the laser is located in a tubular member for emission of a light beam through an end thereof. The tubular member is mounted at the first location with linear freedom of movement, and at a second location with angular freedom of movement relative to the firearm. The laser may be potted or rigidly mounted in the tubular member. A relative position of an aiming mark in the form of a light spot on a target of the firearm may be varied by angular adjustment of the tubular member at the first mounting location or by selectively deflecting the light beam in or at the tubular member.

The present invention differs from the patented invention because the patented invention is a sighting device functioning to aid aiming of a weapon at a target. The present invention is a training aid which functions to convert a live weapon so that it can be used in conjunction with training simulators and activates the laser only when the trigger is pulled.

In U.S. Pat. No. 4,102,532 to Howard K. VanJepmond et al. teaches an electrical circuit for sensing the position of an object with respect to its receptacle. Within the receptacle is mounted a light emitting diode (LED) that generates coded pulses of light. The pulses are sensed by the photodetector mounted on the object. The circuit further includes a clock, gates, and a D flip-flop that together determine whether the photodetector is sensing the coded pulses from the light emitting diode. The light emitting diode and the photodetector are positioned such that the photodetector only senses the coded pulses when the object is located with the receptacle.

The present invention differs from the patented invention because the patented invention is an electronic circuit designed for the special purpose of detecting a premature withdrawal of a weapon from a holding device. This application is used in quick draw video games. The present invention is a training aid which functions to convert a live weapon so it can be used in conjunction with training simulators. The patent referenced is not applicable to the present invention.

In U.S. Pat. No. 4,313,273 to John W. Matthews et al. teaches a firearm having a firing device, a manually cockable and selectively releasable hammer for actuating the firing device and a selectively activatable laser beam emitting device for providing an aiming mark on a target of the firearm. The laser beam emitting device is activated through cocking of the hammer to provide the aiming mark. The cocked hammer is released with a finger trigger for actuation of the firing device only after activation of the laser beam emitting device and provision of the aiming mark.

The invention differs from the patented invention because the patented invention is a device that turns on a laser targeting device when the hammer of the weapon is cocked. The present invention is a conversion of a weapon for use in conjunction with training simulators.

In U.S. Pat. No. 4,363,484 to Jeffery D. Breslow et al. teaches a player response game including game apparatus that directs light beams of relatively short duration from a control housing to opposing player stations and detects light reflected back from the respective player stations. The game apparatus also includes a hand held light reflecting paddle for the player at each station, these paddles having a light diffusing surface so that light is reflected back to the control housing. When the paddle intercepts a light beam irrespective of the exact angle at which the paddle intercepts light the beam. The sequencing and control of the game apparatus by electronic control circuitry including a microprocessor simulates a table tennis game wherein a light beam is directed to either the forehand or the backhand side of the opposite station of a player at one station successively intercepts a beam with his paddle during the time the beam is directed to his or her station.

The present invention differs from the patented invention because the patented invention is a game played with paddles that reflect light to a target and has little to do with the concept or technology of the present invention.

In U.S. Pat. No. 4,403,777 to Robert M. DelPrincipe et al. teaches an electronic game utilizing a phototransducer and a plurality of input switches as inputs to a microprocessor for actuating a display and speaker for providing visual and audible clues to a user in accordance with the internally generated signals. The processor establishes light sensitivity levels for comparison with incident light levels on the phototransducer for processing by the processor in accordance with the timing and duration of the input switches.

The present invention differs from the patented invention because the patented invention is a game played with input switches and has little to do with the concepts or technology of the present invention.

In U.S. Pat. No. 4,695,058 to George Cate III et al. teaches an amusement shooting game for play by a plurality of players (30,40) wherein players (30,40) shoot at each other while avoiding being shot at is provided. The players (30,40) equipment includes a vest module (46) and helmet (44) for generating and transmitting a coded signal uniquely identifying each player (30,40). Each player further utilizes a gun (50) for receiving the transmitted coded signals transmitted by the players (30,40). A processing unit (74) is responsive to the gun (50) for detecting a transmitted coded signal. Data processing devices (126,110,114) are utilized for counting and displaying the number of detected coded signals to provide a score for each player representing the number of players (30,40) he has shot during the play of the game.

The present invention differs from the patented invention because the patented invention is an entire game whereas the present invention is used in training simulators and converts live weapons into firearms simulators.

In U.S. Pat. No. 4,479,266 to Gregoire Eumurian et al. teaches an optical receiver designed for operation in alternating current transmission over a broad temperature range and having a very large dynamic range comprises a capacitor between the transimpedance circuit and two comparator circuits for processing a signal which is coded at three levels. The amplifier can be of a type having a wideband but excluding the direct current component. A threshold generate circuit permits automatic connection of the thresholds t one of a plurality of discrete values which are predetermined as a function of the variation in amplitude of the signal. The optical link transmitter delivers the coded information in accordance with a code having a constant direct current component such as a PBP code, for example.

The present invention differs from the patented invention because the patented invention is an electronic circuit for receiving data transmissions.

In U.S. Pat. No. 4,876,816 to Melvin Triplett teaches a target illuminating aiming system for use with a firing weapon in reduced lighting, is provided with a light assembly for generating light and a light focusing assembly for directing the light generated by the light assembly at a target area into a first zone and a second zone. The second zone generally overlies the first zone and provides sufficient illumination of the target area such than an individual firing the weapon is better able to identify the target area. The first zone is alignable with the trajectory of a projectile fired from the weapon such that the projectile impacts in or near that portion of the target defined by the first zone.

The present invention differs from the patented invention because the patented invention is a targeting means that is switched on and left on during the entire target acquisition and firing sequence. The present invention is actuated when the weapon is fired, emitting a laser beam that simulates the trajectory the bullet would have taken in a real situation. The patented invention must be aligned with the weapons sights. The present invention is aligned to the simulation barrel so no alignment is needed at installation.

In U.S. Pat. No. 4,283,673 to J. Darryl Lieux teaches in a circuit including a transistor pair feeding separate loads at different load voltages, current gain modulation or Early effect is avoided by employing an operational amplifier to maintain the collector-base voltages of the transistors equal and thereby maintain their alpha current gains equal.

The present invention differs from the patented invention because the patented invention is a circuit design which is not relevant to the present invention.

In U.S. Pat. No. 4,754,133 to Charles H. Bleich teaches an infrared transceiver circuit for a toy gun or other novelty item includes an IR detector, a high Q band pass filter and a demodulator in the receiver section to control the operation of a counter which, in turn, actuates lights and sound when a "hit" is detected. The transmitter portion generates an IR signal modulated by an oscillator and square waver generator. The high Q band pass circuit substantially eliminates unmodulated infrared radiation, for example, from sunlight, to increase receiver sensitivity.

The present invention differs from the patented invention because the patented invention is an improved transceiver of IR signals designed to be implemented in toys. The patented invention does not have the precision needed for simulation as does the present invention when it is aligned with the replacement barrel.

In U.S. Pat. No. 4,595,804 to Gunther Stiefehneyer et al. teaches a light emitting diode is energized by converting a mechanical energy by means of a piezoelectric element into electrical charges which are transformed in a transformer into current pulses sufficient for activating the light emitting diode. The component parts of a device of this invention include a rotation-symmetrical housing enclosing a striking member which is spring-biased against an opening in the housing, a piezoelectric element cooperating with the striking member and having two opposite electrodes connected to a primary winding of a pulse transformer. The secondary winding of the transformer is connected to the leads of the light emitting diode. The piezoelectric element is pressed against the compression spring of the striking member by a connection spring leading to a terminal of the primary winding. All component parts are aligned along the center axis of the housing.

The present invention differs from the patented invention because the patented invention does not have an adjustment for controlling the mechanical forces impinging on the piezo element and the patented invention is designed to fit into the breech of a weapon whereas the present invention is designed into the barrel or bolt action of a weapon.

In U.S. Pat. No. 4,195,422 to Herman Budmlger teaches a system for simulating weapon firing comprising a pulse transmitter connected with a weapon for transmitting beam pulses and target device having a hit display. The pulse transmitter comprises a calibrated adjustment device for the beam pulses in order to adjust the hit diameter at the target image plan of the target device to the caliber of the weapon.

The present invention differs from the patented invention because the patented invention is a simulation concept having a simulator specific weapon, target, and control means. The present invention comprises a weapon modification means permitting any weapon to be modified to work with any simulator without affecting the tactile feedback received by the user.

In U.S. Pat. No. 4,538,991 to Anthony Simpson et al. teaches a target apparatus for use in the training of weapon direct fire, including a structure (1) in which a weapon can be placed and which forms a screen (3) of concave truncated spherical shape, at least one target image projector (4) located within the structure (1) for projecting a target image (T) onto the screen (3), with the projector (8) being mounted for universal movement so as to be capable of moving the projected target image (T) over the screen (3), and a visible laser projector (8) located on or adjacent the weapon to produce a visual indication (P) on the screen (3) by a projected beam of visible light, of at least a final portion of the flight path of the simulated fired projectile or missile, corresponding to the position at which the weapon was aimed when fired, for a projectile or missile whose trajectory or flight path cannot be controllably varied after firing or corresponding to the position at which the weapon was aimed when fired and as subsequently controllably varied, for a projectile or missile whose trajectory or flight path can be controllably varied after firing. The target image projector (4) is located in the structure at the center of curvature of the concave truncated spherical shaped screen (3). An infra-red projector (9) may be included to project a beam of radiation along the line of sight of the weapon together with a detector (10) for this beam. The projector (8) may be operable to indicate visually on the screen (3) the impact of a missile or sequence of projectiles on the target image (T) and/or the whole of the flight path of the missile or projectile.

The present invention differs from the patented invention because the patented invention is a large weapon simulator, such as anti-aircraft, that is enveloped within a dome structure. The present invention does not require a dome and is related only to the configuration of a live weapon or firearm simulator.

In U.S. Pat. No. 4,281,993 to Bon F. Shaw teaches a semiconductor laser alignment device for aiming a laser light beam, broadcast by a weapon, along an optical light path such that the laser light beam is in alignment with the aiming direction of the weapon at a target which is located a predetermined distance from the weapon. The semiconductor laser alignment device comprises a tubular housing attached to the barrel of the weapon, a laser diode located within the tubular housing for broadcasting the laser light beam and a projecting lens for collimating the laser light beam broadcast by the laser diode. Zeroing means connected to the laser diode positions the laser diode such that the laser light beam broadcast by the laser diode is in alignment with the line of sight of the weapon.

The present invention differs from the patented invention because the patented invention is a laser alignment device that is used to align a laser to the sights of a weapon and is attached to the weapon . The present invention has the laser aligned to the barrel at manufacture, it does not require realignment once installed in the chosen weapon.

In U.S. Pat. No. 4,380,437 to G. Wirth Yarborough teaches a small weapons simulator in which a plurality of functioning and control modules are supported by a gun body having an exterior configuration to simulate a real weapon. The functioning modules include a laser beam transmitter to synthesize the trajectory of a bullet, recoil simulating means, sound simulating means, and means to develop a lining force on the forward portion of the gun body upon trigger actuation of the trigger the recoil means and the sound simulating means to synthesize the characteristic of muzzle rise on discharging a projectile from the weapon.

The present invention differs from the patented invention because the patented invention is captive to the simulator and cannot be removed, having an umbilical cord connecting it to source of electricity and compressed gas. The present invention is interchangeable with any simulator and it is not attached to electricity or air sources so the user is not restricted to the length of an umbilical cord. The present invention can be removed so that to return the simulator weapon to full live ammunition firing status.

In U.S. Pat. No. 4,983,123 to Bentley N. Scott et al. teaches a markmanship training apparatus used with air guns or weapons firing blank cartridges and comprises a housing member with an attached muzzle alignment tube for insertion into the bore of the barrel of the weapon and includes sealing apparatus around the muzzle alignment and to prevent the gas from pushing the muzzle alightment tube out of the bore. The housing member includes a switch which is activated by the gas to complete an electrical circuit positioned in the housing to cause light energy to be emitted from the housing member.

The present invention differs from the patented invention because the patented invention requires the use of a blank cartridge, the compressed gas of which is used to trigger the firing of a light source. The patented invention is not a replacement barrel or magazine but an attachment to the barrel of the weapon. Further the patented invention outputs non laser light which limits the effectiveness in bright light scenarios. The present invention comprises a replacement barrel containing a laser and a magazine assembly having a power source and processing module.

In U.S. Pat. No. 4,768,958 to Peter Suddaby teaches an alignment plug for mounting a laser beam projector assembly on the barrel of a weapon, comprising an elongate body (10) of substantially cylindrical cross section which a first body portion services for location with the muzzle end of the barrel and a second body portion serves for attachment of the projector assembly. A window (17) in said plug services for entry of light emitted on detonation of a blank round, the light being transmitted to a light detector (14) by a light guide (16) to initiate projection of a coded laser beam. Aperture means (8,9) extending axially of said plug serves to relieve the pressure of the detonation to the exterior of the barrel.

The present invention differs from the patented invention because the patented invention is not a replacement weapon barrel and magazine. The patented invention is mounted to a weapon by fastening it to the end of the barrel. It requires the use of a blank round to simulate the weapon firing and trigger the laser. The present invention is a replacement barrel and/or magazine for the weapon, not an insert and does not require use of a blank cartridge for operation.

In U.S. Pat. No. 4,777,754 to Edward C. Reynolds, Jr. teaches an aim assistance light beam for a firearm having functional parts necessary for the operation of that firearm as a firearm is provided by adaptation of a battery housing to a contour of the firearm below a barrel and ahead of a trigger guard thereof as seen in the direction of the light beam, for reception of an electric battery remotely from a stock of the firearm. A common fastener is provided for that battery housing as well as for one to the necessary functional parts of the firearm, and both that battery housing and that one necessary functional part are attached with that common fastener to the firearm. A light source is mounted on that battery housing for providing an aim assistance light beam upon energization from the battery through an electric on/off switch provided independently of any trigger and hammer assembly of the firearm.

The present invention differs from the patented invention because the patented invention is an aiming assistance device not intended for simulation. No modulation of the light source is disclosed as it primarily functions as a target illumination device. The patented invention is intended to be used with live ammunition. The present invention is a simulator intended to be used without live ammunition, and is not an aim assistance device.

In U.S. Pat. No. 4,856,218 to Edward C. Reynolds, Jr. teaches an aim assistance light beam is provided for a firearm having a barrel and movable fore end assembly for loading shells and actuating a firearm action. A lamp and reflector throws that light beam upon electric energization of a lamp in the lamp and reflector assembly. A battery housing for mounting that lamp and reflector assembly is below the barrel and is in the form of a hand grip for manual actuation of the fore-end assembly. That battery housing is mounted on the fore-end assembly for manual actuation of the fore-end assembly with that battery housing which also contains the battery for electrically energizing the lamp.

The present invention differs from the patented invention because the patented invention is an aiming assistance device not intended for simulation. No modulation of the light source is disclosed as it primarily functions as a target illumination device. The patented invention is intended to be used with live ammunition. The present invention is a simulator intended to be used without live ammunition and is not an aiming assistance device.

In U.S. Pat. No. 4,086,711 to Rudolph Ronald Gammaerino et al. teaches markmanship training devices are provided in which a laser emitter is mounted on a firearm or other weapon at the firing point and in which a reflective target is placed over a desired area on the ultimate target and object and a solar cell type detector is mounted in relatively close proximity to the target to determine if and when a laser emission from the firearm or weapon has impinged upon the target and generate a hit indication of the audible and/or visible type.

The present invention differs from the patented invention because the patented invention mounts on the weapon and is boresighted to the projectile path. The boresighting is a time consuming/expensive operation and precludes using a trainees weapon; therefore the weapons also become simulator captive (forever captive). The patented invention also includes a laser hit indicator that is matched to the specific laser system mounted on the weapon. The present invention is a replacement barrel and magazine that quickly converts a live firing weapon to one that is used as a firearm simulator. Live ammunition is not fired and boresighting is not required. The present invention may be removed from the simulator allowing it to be returned to full operational capabilities.

In U.S. Pat. No. 4,102,059 to Joe W. Kimble et al. teaches a miniaturized laser assembly is mounted on a weapon with the power source and circuitry for the laser assembly being contained within the weapon with no significant visual or actual weight change in the weapons original characteristics. The laser weapon is fired in a normal manner by squeezing the trigger while aiming at a target. The laser emits a harmless invisible signal pulse of coherent light so that if the weapon is aimed correctly a detector indicator unit mounted on a target receives and processes the laser pulse to cause an audible sound signifying that a hit has be registered.

The present invention differs from the patented invention because the patented invention requires a weapon configured as a simulator. It is not a conversion but rather a purposely built weapon. Firing of the weapon is simulated by a blank cartridge. The present invention is a quick conversion of a live firing weapon to a firearm simulator retaining the feel of the live firing weapon. Firing is simulated by all the actions associated with a live firing weapon and a blank cartridge is not utilized.

In U.S. Pat. No. 4,145,111 to Hans Hannsson and et al. teaches an aircraft assembly of retroreflectors for reciprocal-direction reflection of laser beams comprises an aerodynamically slender body having fittings on it medial portion for attachment to underwing supports for externally carried loads. Recessed in each end portion of the body are a plurality of individual retroreflectors, one coaxial and facing endwise outwardly, the rest spaced lengthwise from it and one another and facing in different generally lateral directions with their axes intersecting the longitudinal axis of the body and uniformly inclined towards the adjacent body extremity. The incident sectors of the several retroreflectors at each end of the body slight overlap and complement one another to provide, collectively, a hemispherical incident sector symmetrical to the body axis and complementary to the collective hemispherical incident sector of the retroreflectors at the other end portion of the body.

The present invention differs from the patented invention because the patented invention applies to modification of an aircraft not a individual type weapon. The present invention converts a live firing weapon to a weapon simulator and vice versa.

In U.S. Pat. No. 4,177,580 to Albert H. Marshall et al. teaches a target system is disclosed which is responsive to and indicative of the hits and areas of near misses of laser light pulses that have been shot from a laser weapon aimed at the target system, be it a simulated gun or other device, by a marksman. In addition to the bullseye indicia on the face of the target system, the target system comprises a quadrant arrangement of laser light detectors that are located on the front of the target system in such manner as to permit them to sense the laser light pulses. The detectors are connected in unique combination with data processing channels, programmable timers, a preprogrammed read only memory logic circuit, and an array of lights disposed around and near the perimeter of the target face. The latter mentioned lights light up in accordance with the approximate location of the hits of the laser light pulses related to the bullseye of the target face, thereby indicating either a hit or the direction of a near miss to the marksman.

The present invention differs from the patented invention because the patented invention is a unique target and scoring system and is not compatible with other targeting/scoring systems and is not a weapon not a weapon conversion as is the present invention. The present invention can be made compatible any targeting/scoring system In U.S. Pat. No. 4,481,000 to Windell N. Mohon teaches the present application discloses a low cost method and apparatus for scoring the performance of a trainee in his or her use of a military type weapon in simulation. In the broader view, the invention disclosed determines and records whether the analog value of a test signal is within a preselected range of a preselected analog value. In the intended environment the preselected analog value denotes the centrex of a target. And, the preselected range is the area of proximity to the target that denotes a "hit", and is provided by a steady state voltage that is taken in sum and difference format with the above identified preselected analog value.

The present invention differs from the patented invention because the patented invention is a unique target and scoring system and is not compatible with other targeting/scoring systems and is not a weapon conversion as is the present invention. The present invention can be adjusted to be compatible with any targeting/scoring system.

In U.S. Pat. No. 4,482,326 to Frank Witt teaches a pair of flight training glasses having improved position sensor comprised of a pair of non-parallel photo-cells for preventing monitoring error. An improved lens in the glass has a plurality of segmented portions independently controllable for affecting view sizing and for simulating various cloud conditions during aircraft flight.

The present invention differs from the patented invention because the patented invention describes a special type of eye glasses that degraded simulated flight conditions. The patented invention is not related to a weapon.

In U.S. Pat. No. 4,545,583 to Bruce W. Pearman et al. teaches a simulated fire and hit indicator apparatus and method includes two opponent stations having a gun device and a target device and a master control unit. Each gun device generates a dispersed trigger-active signal and a focused bullet signal; preferably in the form of a modulated pulse burst powering infrared emitters. Detectors, preferably in the form of phototransistors are mounted in each target to sense the bullet signals and each operates to produce a hit signal when struck by an opponent's bullet signal. The trigger-active signals are detected, again preferably by phototransistors, and produce fire signals corresponding to respective gun devices. Each station includes processing circuitry to produce uniform pulse bursts representative of the for and hit signals of the station, and the signals may be mixed and may be used to enable a radio transmitter that broadcasts the fire and hit data to a receiver on the master control. The master control includes decoding circuits to separate the data into component signals corresponding to the fire and hit status of each station. The master control outputs all fire data, but includes logic circuits that prohibit output of a later received hit signal and implements output for an earlier received hit signal. Accordingly, the method comprises the production and processing of these various signals.

The present invention differs from the patented invention because the patented invention is a unique, entire fire and hit simulation device having a device specific weapon and is not compatible with other simulation systems. The present invention is a quick conversion to a trainees own weapon, retaining the feel of the trainees weapon. The present invention can be adapted to any simulator.

In U.S. Pat. No. 4,561,849 to Kurt Eichweber teaches device is disclosed for combat simulation, in which each weapon carrying combat participant has a laser transmitter, an optical measurement receiver, and an analyzer, and each target object combat participant has reflector elements, an optical information receiver and a device for evaluating the optical information. When firing is simulated, the target is tracked with laser pulses which are transmitted by the laser transmitter and reflected by the reflector elements back to the measurement receiver. The hit accuracy information is optically coded and sent back to the target. According to this invention, optical signal or beams for target tracking and for information transmission are spatially separated from each other by distributing the reflector elements in the vulnerable area of the target but locating the optical information receiver separately, preferably in an exposed location. The reflector elements may be inexpensive disposable elements. Signal transmission between the various components can be accomplished by opto-electronic links without the use of cables. On receipt of a "hit" signal, an optoelectronic link which activates the laser transmitter can be unavoidably switched off to inactivate the combat participant that has been hit without any possibility of tampering by the combat participant to prevent this.

The present invention differs from the patented invention because the patented invention is a device for a large scale combat simulation ad includes hit/miss indicators, body mounted reflectors and weapon mounted devices for transmitting a laser pulse. The present invention describes a device that would function with and in the patented invention. The present invention is a conversion of a weapon to use in a simulator while the patented invention is a training simulator and requires dedicated firearm simulators.

In U.S. Pat. No. 5,034,747 to Christopher A. Donahue teaches a detachable radar unit for a motorcycle is presented. An outer shell is permanently attached to the side of a motorcycle helmet. A radar sensing unit may be inserted into the shell making electrical contact with a microphone and light panel attached to the helmet. The radar sensing unit may also be detached from the helmet and attached to a car or boat by using separate shells permanently mounted on the car or boat. A special disconnect plug in the unit's power supply cord is provided which quickly and easily disconnects the helmet from the motorcycle should the need arise.

The present invention differs from the patented invention because the patented invention is a police speed radar detector. It is not a laser firearm simulator and does not transmit a laser pulse.

In U.S. Pat. No. 5,040,322 to Juan Iturrey teaches a nightshooting aid which provides the user with the ability to shoot accurately in a low light environment. It comprises a structural device having a flashlight-engaging member along one edge, and a weapon-retaining member along the opposite edge, at a laterally removed located from the flashlight engaging member. In this way a flashlight and a weapon supported by the structural device can be aimed in a common direction. The arrangement is such that the aim of the weapon is coincident with the aim of the flashlight at twelve to eighteen feet in front of the user. Two different embodiments of the weapon retaining member are disclosed for engagement with either a revolver or a semiautomatic. A further feature of indentations on the underside of the device is also disclosed which adds stability to the device.

The present invention differs from the patented invention because the patented invention is a target illumination device and is used in conjunction with a live firing weapon. The patented invention does not convert a live firing weapon to a firearm simulator.

In U.S. Pat. No. 5,044,107 to John E. Holford teaches an individual radio communicator is integrated with a weapon such that the communicator is part of a rifle stock or its equivalent and the weapon barrel becomes an antenna and/or an aiming light on the weapon becomes an optical channel for convert radio transmission.

The present invention differs from the patented invention because the patented invention is a weapon mounted communication device and as such is not relevant to the present invention.

In U.S. Pat. No. 5,119,576 to Torsten Erning teaches a long or short firearm wherein an essential part for the firing of ammunition can be disconnected from the housing to be replaced with an attachment which carries a laser. The laser is operated to emit a beam of radiation against a selected target in response to depressing the trigger which is carried by the housing. A circuit is provided to determine the duration of emission of radiation in response to depressing the trigger. The energy source for the laser can be confined in the magazine of the housing and/or in the attachment. A sight on the attachment assumes the same position with reference to the housing as a sight of the detachable essential part when the attachment is connected to the housing in lieu of the essential part. The essential part can include the barrel and the firing chamber of a short firearm or the bolt action of a long firearm.

The present invention differs from the patented invention because the patented invention has a laser generating means that installs in the firing chamber and the barrel is re-attached. The present invention is a replacement barrel containing the laser generating means. The patented invention has a breech insert that acts as the trigger for the laser pulse. The present invention permits the conversion of the live firing weapon to a firearm simulator and reconvert the simulator to a live firing weapon. The patented invention does not permit reconverting the laser weapon to a live firing weapon.

In U.S. Pat. No. 5,153,375 to Julian Equizabal teaches an ammunition cartridge for simulated firing using a laser beam, this comprising a casing which is bored longitudinally and provided with, at the inlet of the bore, a percussion cap, the outlet of the bore fitting the orifice of the firearm barrel, its external form including additional forms of a casing and a conventional bullet.

The present invention differs from the patented invention because the patented invention is an ammunition replacement that simulates the recoil and sound of a weapon discharge using percussion cap. The laser device is not specified. The present invention does not use ammunition to achieve the function of a firearm simulator.

In U.S. Pat. No. 5,351,429 to Wilson H. Ford teaches an aiming device includes a laser housing attached to the trigger guard and adapted to fit snugly on the receiver assembly of a gas operated, slide actuated automatic weapon. The laser housing is provided with two vertically aligned parallel running compartments. The upper compartment contains the laser emission module while the lower compartment contains the power supply. The rear of each compartment is provided with a passage which opens to a slot in the rear of the housing to provide access for the electrical connection of the power supply, the laser emitter and actuator switch which is carried in the slot. In this manner all electrical components for operating the aiming device are contained within the laser housing.

The laser emission module consists of a laser diode and associated laser driver circuitry in a container configured to be received in the upper compartment of the laser housing. The emission end of the container is provided with one or more lenses for focusing the laser beam. The laser module has smaller outside diameter than the inside diameter of the upper compartment to provide room to move the module to adjust the windage and the elevation of the laser emission.

The present invention differs from the patented invention because the patented invention is an aiming device specifically adapted to a gas operated automatic weapon which uses live ammunition. The patented invention is not a simulator.

In U.S. Pat. No. 5,365,669 to Joseph M. Rustick et al. teaches a boresight for determining the accuracy of a gunsight wherein a cartridge shaped housing is dimension to fit with the gun chamber. A laser is contained in the housing. A switch is positioned in the end surface of the boresight housing to be contacted by the bolt face of the gun. The switch contains an indentation to receive the firing pin when the bolt face contacts the switch to activate the laser and illuminate a distant spot.

The present invention differs from the patented invention because the patented invention is a boresight device used to determine the accuracy of a sighting device attached to the weapon. The patented invention is not a simulator. The present invention converts a standard weapon into a weapon simulator and can reconvert the simulator into a standard operational, live ammunition firing weapon.

In U.S. Pat. No. 5,375,847 to Wayne G. Fromm et al. teaches a toy assembly 10 including a ray gun 12 capable of projecting a focused beam of light 25, and an electromechanically actuatable target figurine 14 include a body 46, a support 48 for supporting the body of the figurine in an upright position upon a surface, a light receiver 58, a toppling mechanism 60 for causing the figurine to topple over when operated, an energy source 82 within the figurine for powering the toppling mechanism, and a control circuit 78 for initiating the operation of the toppling mechanism when the light receiver is struck by a beam of light projected by the ray gun.

The present invention differs from the patented invention because the patented invention is a children's toy. It does not use real weapons and the weapon of the patented invention is specific to the toy. The patented invention is not relevant to the present invention.

In U.S. Pat. No. 5,388,364 to Arthur Paldino teaches a laser gunsight for automatic hand guns is disclosed. The laser circuitry, diode and lens are contained in a cylindrical shaft which replaces the usual recoil spring guide. Electrical power for the sight is supplied from either of two pairs of batteries mounted in plastic panels in the gun handle. Current is carried through conductive strips embedded in the plastic panels. The slide return and cross bar which are electrically insulated from the gun frame, and an electrically insulated longitudinal pin the cylindrical shaft. An on-off button switch on one side of the handle makes or breaks contact with the conductive strips in the plastic panel. The circuit is completed through the gun frame and which is in conductive contact with the batteries when the magazine is mounted in the gun. When the magazine is removed for loading, the circuit is interrupted, which in combat situations serves to assure that the laser is not inadvertently activated and the user's location revealed.

The present invention differs from the patented invention because the patented invention is an aiming device for semiautomatic weapons that is built into the weapon. It is not retrofitable as is the present invention. The patented invention is not used for simulation.

In U.S. Pat. No. 5,401,025 to Jay Smith et al. teaches the present invention is a remote control targeting and control system for use with a standard raster scanned television and an associated gaming unit. The remote control system includes a mobile transceiver and a fixed transceiver which communicates with the gaming system. The system implements a simple communications systems which allows the mobile transceiver to ordinarily transmit position data and to periodically transmit button press data. The mobile transceiver includes an electro-optic detector for observing when a scan line crosses a target area. Each time a scan line is detected, the mobile transceiver transmits a pulse to the fixed unit, based upon which the gaming unit translate the pulse into position data based on the time of its detection. The button press data is transmitted synchronously with the raster scanned television in that the fixed transceiver is caused to transmit a single pulse during each vertical retrace of the television. The preferred remote control system is contained in a gun-shaped main unit of a multipiece housing. A stalk and a sighting system having viewing tubes may be optionally attached to the main unit. The sighting system is comprised of a pair of viewing tubes and a rotatable sighting tube which may be placed in front of either sighting tube.

The present invention does not implement wireless communications of position and laser shot placement data and differs from the patented invention because the patented invention is a toy device used with a target presented on a TV screen. It is wireless, using an IR data transmitter to interface with the game box. It is not a simulator used for and in conjunction with training simulators.

In U.S. Pat. No. 3,938,262 to Richard A. Dye et al. teaches a realistic laser weapon simulator is disclosed which utilizes a laser transmitter in combination with a rifle for teaching marksmanship by firing laser "bullets" at an infrared equipped target. The laser weapon includes a piezoelectric crystal coupled to a laser in a housing for mounting axially to a rifle barrel. The rifle may develop a mechanical force by firing a blank cartridge which generates shock waves and vibrates the piezoelectric device. A mechanical force may also be applied direct to the piezoelectric device by the rifle's hammer.

The present invention differs from the patented invention because the patented invention is not a firearm simulator that can convert a standard weapon to a weapon simulator and also return the weapon simulator to a standard weapon as is the case with the present invention. The present invention does not mount externally to the barrel.

In U.S. Pat. No. 3,898,747 to Albert H. Marshall teaches a weapon direct fire kill simulator system in which a laser transmitter means of dual mode, narrow and broad beam projection capability, a hit receiver actuator means and hit indication means all fixed to a weapon to be simulated and having a trigger switch are combined with a man target means having retroreflecting apparel or patches to reflect the narrow fire beam back to the receiver-actuator and combined also with a 360 degree kill detector-actuator means to receive the kill beam to actuate a kill indicator alarm also made a part of the man target wearing apparel. The invention also contemplates a timing means and adjustable range gate means to disable the system when the target is beyond the simulator weapon's range, comparator means to eliminate noise signals below the value of the hit indicator signals, and disable means to inactivate a man target once hit. In composite, the system provides immediate hit indication to the trainee and kill indication to the man target while also correcting for weapon characteristics. The present invention differs from the patented invention because the patented invention is a dedicated simulator specific weapon not a conversion of a standard weapon.

In U.S. Pat. No. 3,629,691 to Carl Franklin Wheatley, Jr. teaches a semiconductor current source adapted for integrated circuit fabrication. A first transistor and a second diode-connected transistor have their base-emitter circuit coupled in parallel. A current-determining resistor is connected between the emitters of the transistors. The effective base-emitter junction area the diode-connected transistor is greater than that of the first transistor. The effective base-emitter junction are of the diode-connected transistor is greater than that of the first transistor. The collectors of the first and second transistor are coupled to feedback circuitry which tends to maintain their collector currents substantially equal despite the difference in device areas. A difference in base-emitter voltage of the two transistors appears across the emitter resistor and determines the operating current level.

The present invention differs from the patented invention because the patented invention is an electrical circuit and is not relevant to the present invention.

In U.S. Pat. No. 3,510,965 to R. S. Morrow teaches an electrically actuated light bulb and focusing lens which inserts into the barrel of, for example, a revolver. Energy for lighting the bulb is connected to one electrode of the bulb through the portion of the device in the barrel and to the other electrode through the metal portion of the revolver. When the trigger is pulled, the firing pin strikes the cartridge unit in the chamber for completing the electrical circuit. Light from the bulb appears, for example, on a target where the revolver was pointed.

The present invention differs from the patented invention because the patented invention is a light bulb triggered by a hammer action. The patented invention inserts into the barrel of the weapon, it is not a replacement barrel. The use of a light bulb significantly limits the effectiveness of the patented invention for training use versus the present invention.

In U.S. Pat. No. 3,510,695 to Paul Laupera teaches a non-liner resistance network of an apparatus providing for constant adjustment of the partial current therein. An input current line and an output current line are connected by a pair of branch circuits each having a partial current flowing therethrough, with the non-linear resistance network being connected in one branch circuit and with a transistor having its collector-emitter circuit connected in the other branch circuit and its base connected to the one branch circuit.

The transistor controls the current distribution in the two branches so that the ratio of the partial current in the non-linear resistance network to the input current is maintained constant.

An adjustable resistance is connected in series in each branch circuit and the partial currents in the two branch circuits are inversely proportional to the adjustable resistances therein. A diode may be connected in series with the non-linear resistance network to match the relatively small voltage drop in the base-emitter circuit of the transistor. Alternatively, a second transistor can have its collector-emitter circuit connected in series with the non-linear resistance network, and its based connected to the base of the first mentioned transistor. In this case, the control current for the two transistors is supplied through a further resistor connected between the input current line and the line connecting the bases of the two transistors.

The present invention differs from the patented invention because the patented invention is a circuit design and is not relevant to the present invention.

In U.S. Pat. No. D 310,492 to Leo O. Taylor et al teaches the ornamental design for helmet photodetector array, as shown. The present invention differs from the patented invention because the patented invention is a sensor array not a simulator.

In U.S. Pat. No. D 347,027 to Ronald Phillips teaches an ornamental design for a video game pistol holder as shown and described. The present invention differs from the patented invention because the patented invention is a design for a device that converts a toy pistol into a toy rifle. The patented invention is not relevant to the present invention.

In U.S. Pat. No. 5,419,072 to Larry Moore et al. teaches an internally mounted laser beam gun sight suitable for use in automatic pistols is provided by replacing the conventional recoil spring guide rod with a hollow tube having substantially the same exterior shape and dimensions but containing a laser beam generation module, batteries and an on/off switch within its hollow bore. In a preferred embodiment, the hollow tube has two portions which are moveable with respect to each other. A first portion contains the batteries and a second portion contains the laser module. An insulated bushing containing a central electrical contact is located between the two portions. In the preferred embodiment, the central electrical contact forms a part of an internal electrical switch which is activated by relative motion of the first and second portions of the guide tube to turn the laser beam on and off.

The present invention differs from the patented invention because the patented invention is an aiming device not intended to be used as simulator. It is not an interchangeable barrel. The present invention converts a standard weapon into a weapon simulator and also permit the conversion from the simulator back to the standard weapon.

In U.S. Pat. No. 4,487,583 to Stephen Brucker et al. teaches a weapons engagement simulation system including a weapon simulator having a laser transmitter for transmitting pulses of directed coherent light in a characteristic temporal pattern and a receiver garment. A plurality of photosensitive detectors distributed over each of a plurality of discrete zones on the outside fo the garment respond to the light from the laser transmitter by producing electrical signals systematically related thereto. Comparators compare the electrical detection pules from the photosensitive detectors in a respective zone with a predetermined threshold level and produce discriminating detection pulses when said electrical detection pulses are greater than the threshold level. A decoder compares the temporal patterns of the discriminated detection pulses with a temporal pattern characteristic of the laser transmitter and produces a hit signal corresponding to a respective correction zone when the compared patters correspond. Visual indicators disposed in respective zone provide visual signals when actuated by the respective hit signals, priority is given to hits in accordance with predetermined priority given respective zones.

The present invention differs from the patented invention because the patented invention is a dedicated simulator specific weapon; it does not use a standard weapon converted for use in a simulator. The laser transmitter is mounted internal to the barrel and is triggered by a sensor located in the hand grip, not the impact of the weapon hammer on the piezoelectric module as is the case in the present invention. In addition, the present weapon provides for the conversion and reconversion of a standard weapon to a weapon simulator and vice versa.

In U.S. Pat. No. 4,830,617 to Roger Hancox et al. teaches an apparatus for the simulated shooting of small arms comprising a miniaturized electrical energy source for a radiation emitter which is capable of being accommodated within a dummy cartridge or within the gun barrel. The source can be a capacitor slidably located within the dummy cartridge and which co-operates with a barrel unit housing a switch section, an electronic section, and a pulsed infra-red emitter. On firing the gun the capacitor is propelled forwards by the firing pin of the gun until a probe-like switch portion on the capacitor contacts a corresponding switch portion on the barrel unit so actuating the emitter to give a series of time pulses which pass through a lens system.

The present invention differs from the patented invention because the patented invention uses a capacitor as the power source which must be charged prior to use and is contained in a dummy cartridge. The present invention uses a piezoelectric device to trigger the laser that doe not require charging and can be used repeatably. The patented invention laser module installs in the barrel of the weapon requiring boresighting to the weapon sites. The present invention is a replacement barrel having the laser previously boresighted so the changeover is quickly accomplished.

In U.S. Pat. No. 5,425,299 to James Teetzel teaches a silencer apparatus that can be attached to a standard autoloading handgun having a laser sight module mounted to the front face of the slide of the handgun. The silencer module features additional electronics so that the firing status of the firearm can be ascertained. A skid plate protected switch in the magazine compartment of the handgun provides information as to whether a new clip has been inserted. A flash detector provides a digital read-out of remaining rounds to be fired. Also, the accumulated fired rounds is provided to enable the user to know when the silencer needs cleaning. Noise reduction is provided by a metal honeycomb.

The present invention differs from the patented invention because the patented invention is a weapon aiming device and a silencer used with live ammunition. It is not a simulator.

In U.S. Pat. No. 5,430,967 to Wallace Woodman et al. teaches a clamping mechanism is provided for attaching an auxiliary apparatus to a weapon having a frame. The clamping mechanism has projections which are biased by a flexible member toward corresponding recessed portions formed in the frame of the weapon. A retaining member is also provided which may be moved between an open and a closed position. In the closed position, the flexibility of the flexible member is minimized, such that the projections of the clamping mechanism are locked against the corresponding recessed portions of the weapon. In the open position, the flexible member may bend away from the weapon thereby disengaging the projections of the clamping mechanism from the recessed portions of the weapon. A battery housing is also provided for receiving a battery casing which holds one or more batteries. The batteries are provided for energizing the auxiliary apparatus. The battery housing has a cavity formed therein. A recessed portion is provided in the surface of the cavity for receiving a projection formed in the battery casing. A spring member is provided for biasing the projection of the battery casing toward the recessed portion of the cavity to maintain the battery housing in a closed position.

The present invention differs from the patented invention because the patented invention is a clamp not a simulator device or training system. The patented invention is not applicable to the present invention.

In U.S. Pat. No. 5,435,091 to Ronald Toole et al. teaches a handgun sighting device forming an integral part of the handgun and employing a laser device for projecting a laser beam. The laser device is included in a laser assembly disposed adjacent the top portion of the handgun's handgrip rearward of the trigger and extends laterally away from the handgrip a distance sufficient to allow the projection of the laser beam, while not being obtrusive to the user. For powering the laser device, the sighting device employs driving circuitry preferably disposed within the handgrip. For selectively enabling the laser device, the sighting device employs a switch mechanism preferably accessible on the handgrip. The sighting device, in one embodiment, is adapted for use with handguns having handgrips with removable grip panels and, in another embodiment, is adapted for use in handguns that do not employ removable grip panels.

The present invention differs from the patented invention because the patented invention is a sighting device and is not applicable to the present invention.

In U.S. Pat. No. 5,448,834 to Chao C. Huang teaches a telescope sight collimating device including a laser aimer, a longitudinal center axle at one end of the aimer sleeved with a split sleeve and threadably engaged with a lock nut at its front end for positioning the device in the barrel of the gun, a tapered tubular locating rod and a tapered tubular tightening up rod respectively mounted around the longitudinal center axle and engaging both ends of the split sleeve, as an adjusting nut mounted around the longitudinal center axle and turned in either direction to move the tapered tubular tightening rod forward or backward, causing the sleeve to be fixed to or released from the inside wall of the barrel of the gun.

The present invention differs from the patented invention because the patented invention is an aiming device while the present invention is a firearms simulator.

In U.S. Pat. No. 4,117,282 to Michael Ieda teaches a timing mechanism for controlling actuation of a switch in a toy gun in order to produce a burst of light of a predetermined duration includes a housing and a switch actuating member movable mounted in the housing for movement between first and second positions.

The present invention differs from the patented invention because the patented invention is a timing mechanism whereas the present invention is a firearms simulator.

Numerous innovations for laser firearm systems have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to these interactive firearm training systems wherein a firearm simulator is required to represent a "real" firearm allowing the user to engage in use of the training system for electronic/videographic interactive judgmental training in virtually "real" situations. The simulator training systems have been shown to minimize cost, emphasize safety, and provide more concentrated and effective situational firearms training.

The invention specifically provides the user with the capability to convert their own personal/service firearm into a firearm simulator which is functionally compatible with their interactive training system. After completing the interactive training exercise the converted firearm simulator can be quickly converted back to the original live firing personal/service firearm.

A weapon simulator system is disclosed which utilizes a laser transmitter, signal processing electronics, piezoelectric trigger switch, and intelligent magazines or clips to provide exceptional flexibility and adaptability to the general weapon classes of handguns, shotguns, rifles (magazine or clip ammunition feeds), machine guns, submachine guns, and any other projectile firing firearms. The weapon simulator converts the personal or service weapon into a weapon simulator for interactive training and is easily converted back to a live ammunition firing weapon by simple interchange of simulator parts and OEM parts (easily accomplished by the weapon user). The weapon simulator also adds designed in and graphic safety features to assure that live ammunition cannot be chambered and fired in the weapon simulator. The modular construction provides broad flexibility to upgrade the weapon simulator to be interactive with a plurality of interactive training systems, existing and future. Electronic functions and controls are further provided in the magazine or clip means through interconnection to the various modules contained within the present invention weapon simulator.

There are many other unique features of the invention that makes even the thought of simulator obsolescence a thing of the past. The modular, microprocessor/microcontroller implementation, miniaturized packaging and inherent design of the system through coupled and interconnected modules allows for the following:

A) ease of adaptation to the various interactive training systems currently in use, B) rapid upgrading to meet the operational standards of new interactive training systems, and C) ease of maintenance and repair thereby reducing time and costs.

Further cost savings are realized by the reduction in inventory and added cost of dedicated firearm simulators since this invention utilizes the personal/service firearm of the user.

The present invention relates to a firearm training device that can be inserted into any firearm in place of the original equipment manufacturer (OEM) barrel and magazine and or barrel and clip configuration of a generalized live ammunition firing weapon.

The present invention consist of a Laser module, processor-controller module, piezo module, and power module. The conversion permits the converted firearm to operate in concert with any know interactive training system that exists today. The unique design also allows the converted firearm to be retro-converted to the original configuration by removing the firearm training device. The conversion time is short since it only requires exchanging the barrel and or the barrel and the magazine.

A major advantage of the present invention over the prior art is that the conversion is done to the users weapon, retaining identical tactile feedback in training as in standard, live ammunition use. The conversion is designed with such adjustable features to be compatible with any training system known today or developed in the future. The present invention specifically provides the user with the capability to convert their personal service firearm for purposes of simulator training and then reconverting his own personal service firearm to the original live ammunition firing configuration for use in his line of duty.

The modular packaging and inherent design of the systems and modules allow for rapid maintenance, repair, replacement and or upgrades at the module level thereby reducing cost and time. These features therefore permit the flexibility to adapt to virtually all firearms training simulators in use and their next generations.

The present invention solves the "irreversible" aspects of current firearm simulators by providing:

A replaceable simulator barrel assembly that can be exchanged for the OEM barrel assembly.

A replaceable simulator magazine/clip assembly that can be exchanged for the OEM magazine/clip assembly.

Processor electronics that are integrated into the simulator barrel assembly and which barrel assembly further permits variation of electronic functions including modulations techniques.

A Piezo assembly which electro mechanically activates the processor electronics and laser emitter and which piezo assembly is integrated into the simulator barrel assembly.

In addition to the foregoing features, the present invention provides other features such as:

SAFETY FEATURES

Live ammunition cannot be chambered with the present invention installed.

The present invention utilizes safety acknowledged orange blaze colored material for barrel and magazine/clip parts of the simulator thereby attracting attention to the simulator configuration of the present invention. Such attention means signifies the weapon as a weapon simulator and precludes the possibility that the weapon would be misidentified as anything other than a simulator.

Laser Warning Labels are placed on highly visible locations to assure that the user's attention is attracted to the Laser Warning Labels.

MODULAR DESIGN

The modular design permits the retrofit, upgrade, replacement, and other modifications without modifications to the OEM parts of the weapon.

The modular design is compatible with virtually any projectile firing firearm (handgun, shoulder fired, tripod mounted, or other types).

Modular unit design which significantly reduces the possibility of firearm simulator obsolescence since each module can be exchanged or updated by the users to keep their simulator contemporary.

In addition to the overall system unique features of the present invention, there are several sub-system or module unique features that further enhance system performance and reduce overall cost of owning and operating a firearm simulator. The module unique feature are:

LASER MODULE

The laser module's inherent design allows use of almost any laser known today, including pulse code modulated lasers, frequency modulated lasers, and axis oriented lasers.

The laser module design permits replacement and/or upgrade by the user within minutes. As new and more efficient or powerful lasers are available, user upgrade is achievable.

Inherent design of the laser module permits signal conditioning from the invention's processor module(s).

The laser module also solves the problem of alignment and sight adjustment. The laser module design incorporates a locking slot that locks the laser orientation to the x and y axis and the barrel housing assures bore sight accuracy without additional adjustment.

PROCESSOR MODULE(S)

The processor module(s) design provides the signal conditioning circuits for the laser to ensure system compatibility with any known interactive training system today and allows compatibility with future training systems without major retrofit and/or major redesign.

The processor module design utilizes either discrete components, hybrids, microprocessors, microcontrollers, application specific integrated circuits (ASICS), or combinations thereof to condition signals to the laser.

Amplitude, power, pulse width, modulation characteristics, protocol sequence, operational functions, fail/safe circuits, shot counters, etc. are accessed, controlled, added and/or deleted within the processor module(s) therefore assuring operationally accurate firearm simulator functionality and training system compatibility.

The inherent design of the processor module allows change out and/or addition/deletion of other processor modules by the user in virtually minutes.

Additional processor capacity is also available by either extending the processor module or adding an additional processor module depending upon operational requirements and/or complexity. When additional processor capacity is required, the system design allows the movement of the Power Module to the magazine or clip wherein it is located in the position allotted for extra capacity.

PIEZO MODULE

The piezo module design incorporates the trigger or switch actuation providing voltage to the processor module (s) from the battery module(s) and can also be replaced and/or upgraded by the user in minutes.

The piezo module incorporates proprietary mechanical and electronic designs that permit sensitivity adjustments for each and every firearm known today. Since the transmitted shock, vibration, frequency, and resonance vary for every firearm type and model (depending upon design, material, and inherent tolerances) the piezo module must have the ability to sense and compensate for these difference through calibration and adjustment of the mechanical and/or electronic parameters of the module.

The inherent design of the piezo module would allow the piezo module to be recalibrates to a different firearm if the user were to change firearm types or modules; however, the firearm simulator would have to be returned to the original equipment supplier/manufacturer for this adjustment and calibration.

POWER MODULE(S)

The design of the power module(s) allows for varied power requirements of the firearm simulator. Different configurations of the modules provide for either series or parallel connection for increased current and/or voltage requirements.

The packaging of the power module utilizes "off-the-shelf" batteries allowing simple replacement by the user. As additional high technology and high capacity batteries become available they will be incorporated into the power module design and made available to users as an upgrade.

As firearm simulator requirements change or the firearm simulators are upgraded, simple changes by use of jumpers and/or connector placement allow the power module(s) to meet the changing requirements.

INTELLIGENT MAGAZINE/CLIP ASSEMBLY

This configuration combines functions including but not limited to: the power sources (battery(s)), a microprocessor/microcontroller to add computer intelligence to the overall weapon simulator invention, receiver/transmitter to provide wireless communications with the interactive system, and other functions as appropriate. The microprocessor/microcontroller can be programmed to monitor and control the applicable parameters and functions. For example, the microprocessor/microcontroller can monitor battery status, number of laser shots fired, coded identity of the weapon simulator, etc. The receiver/transmitter provides wireless communications with the interactive system computer and can be used to transmit and receive weapon status, battery status, weapon identity, and other appropriate data and information.

CABLE/CONNECTOR SYSTEM

The cable/connector system provides the link between the magazine mounted module(s) and the barrel mounted modules when necessary as a result of increased requirements. The inherent design provides the capability of changing pin arrangements, and addition/deletion/change of programmable jumpers to accommodate requirement variations.

In summary, the invention has been specifically designed to utilize the most flexible combination of system design/packaging, module design/packaging, and innovative interconnect design to achieve maximum versatility in meeting the varied requirements of both manufacturers of interactive training systems and their users. This system can be configured to be compatible with any know training system today and meet the demanding and individual requirements for firearm simulators identified by their customers and users.

Note that each of the modules interconnects in such a manner as to form a very sophisticated laser, optical, electronic and mechanical system and readily adaptable not only to a wide variety of weapons but also to integration of new technology into any or all of the present inventions subsystems.

There will be those cases where the higher levels of sophistication and functionality are not required. In those cases, the level of integration is lowered by removing a module or modules or even changing module types.

Therefore, the modular design inherently provides functional sophistication from the lowest level to the highest level of functionality and modern by virtue of timely integration of new technologies. The modular design of the present invention and the various electronic, mechanical, and optical functions that can be designed into the modular concept of the present invention.

As one would expect, there are certain parts of the present invention that would be mounted into the barrel, breech, bolt action, or ammunition chamber of the weapon.

The modular design of the present invention allows various level of module integration into various subassemblies of a generalized weapon. For example, the laser module in the only module that needs to be mounted in the boresight path of a weapon; that is, in any part of the weapon whereby the laser beam would follow the boresight line of the weapon without the need for any mechanical adjustments.

The preferred embodiment for the present invention is based on the replacement of the OEM barrel assembly with a generic barrel assembly associated with any individual or crew served weapon be it manual one shot, semi-automatic, automatic, bolt action, revolver action; magazine or clip fed ammunition, as described in the claims, insertable electronic and mechanical functions into the simulator barrel assembly, and a magazine containing other electronic and mechanical functions; including but not limited to microprocessor(s), memory microchips, power sources (batteries; rechargeable and on non-rechargeable, sensors, counters, etc.)

For the purpose of a semi or fully automatic handgun, the utilization of the present is straightforward; however, for replacement of a barrel assembly in a rifle type weapon or crew served weapons may encompass replacement of the OEM assembly that contains the barrel assembly. For example, the U.S. Army M-16 standard issue rifle, has an upper assembly which contains the barrel, carrying handle, sights, etc. and is separable from the lower assembly which contains the firing mechanisms, the magazine structure, and recoil springs, tubes, etc.

LASER MODULE

The laser module consist of Graded Index Optics, a laser diode, and electronic driver circuitry to drive the laser diode. The Optics are mounted in a threaded tube that allows for mechanical focusing of the laser beam over a wide range of distances.

All other modules can be so arranged in the weapon to provide the applicable functionality at minimum cost.

SIGNAL PROCESSING MODULE

The signal processing module provides all other signal processing functions not performed by the microprocessor/microcontroller module. Note that the present invention could be configured to use either, in combination the signal processor and/or the microprocessor/microcontroller module.

INTELLIGENT MAGAZINE/CLIP

Every weapon capable of firing more than 1 round without the user manually loading the weapon must have a place to store ammunition in various forms to be used upon demand.

The present invention utilizes such ammunition storage areas to housing other modular functions such as batteries (power module) and logical processors (i.e. microprocessors and microcontrollers), and solid state memory.

The intelligent magazine communicates with all other modules not contained in the magazine/clip volume. The intelligent magazine may be optionally wireless.

Since the volume of the ammunition storage areas is generally much larger than the volume of the barrel, the functional capacity of the present invention is significantly enhanced and a significant improvement over the prior art.

The intelligent magazine also contains wireless and wire communications means to provide for the transmission and reception of data to further increase the "reality" of situational training.

PIEZO MODULE

The piezo module provides electromechanical functions associated with the impact of a firing pin or fall of the hammer of a weapon. The design of the piezo module consist of a Piezoelectric material, spring, spherical interface, and mechanical firing interface.

The mechanical firing interface is struck either by the hammer fall or firing pin of a weapon. The mechanical shock is transmitted to a spherical ball which acts to compress a spring which acts to exert mechanical force on the piezoelectric element which react to produce an electrical output.

The Piezo module of the present invention utilizes mechanical structures to limit the force applied to the piezo element which affects the characteristics of the electrical output of the piezo element.

Piezoelectric means comprises a switching means whereby an impact block coupled to a generally spherical shaped ball further coupled to a spring further coupled to a piezoelectric crystal said piezoelectric crystal having electrical outputs communicating with trigger means and power means and signal processing means. Switching means comprises an electrical switch communicating with the trigger means, trigger means of said live ammunition firing weapon communicates with said power switching means contained in the simulator barrel assembly.

The types of problems encountered in the prior art are firearms simulation requires a user to utilize a different firearm than the one he/she routinely works with.

In the prior art, unsuccessful attempts to solve this problem were attempted namely: similar shaped and sized firearms to the user's own fire arm. However, the problem was solved by the present invention because it utilizes the user's own fire arm with a retrofitted barrel and/or ammunition magazine.

The present invention went contrary to the teaching of the art which teaches simulated firearms incorporating a laser therein.

The present invention solved a long felt need for a user to utilize the same firearm in training as in the field.

The present invention produced unexpected results namely: users could practice at home to improve their shooting accuracy.

A synergistic effect was produced utilizing the present invention due to the following facts and results from experimentation: shooting accuracy as well as perpetrator recognition increased by utilizing the retrofittable laser system.

Accordingly, it is an object of the present invention to provide a retrofittable laser system that avoids the disadvantages of the prior art.

More particularly, it is an object of the present invention to provide a retrofittable laser system that is simple and inexpensive to manufacture.

In keeping with these objects, and with others which will become apparent hereinafter, one feature of the present invention resides, briefly stated, in a retrofittable laser system is that it is compatible with any semi-automatic handgun or revolver.

When the retrofittable laser system is designed in accordance with the present invention, it is compatible with any semi-automatic or automatic rifles.

In accordance with another feature of the present invention, it is compatible with any semi-automatic or automatic submachine guns.

Another feature of the present invention is that it is compatible with any bolt action rifles, whether magazine fed, clip fed, or tube fed.

Yet another feature of the present invention is that it includes a means for converting a plurality of live ammunition/projectile firing firearms into a firearm simulator.

Still another feature of the present invention is that it that includes the means for converting the present invention firearm simulator back into a standard, live ammunition/projectile firearm.

Yet still another feature of the present invention is that it maintains the same ergonometric characteristics of the standard, live ammunition firing firearm after it has been converted to a firearm simulator.

Still yet another feature of the present invention is that it that will not become obsolete with the introduction of new interactive training systems.

Another feature of the present invention is that it is constructed in modular form such that any or all of the modules can be individually modified or upgraded in order to negate obsolescence or meet new requirements.

Yet another feature of the present invention is that the laser means does not require any adjustments to assure boresighting of the laser means.

Still another feature of the present invention is that a graded index (GRIN) optical means is utilized for focusing of the laser means.

Yet still another feature of the present invention is that a secondary mechanical means for focusing of the laser means is also present.

Still yet another feature of the present invention is that a graded index optical means and a lensing means communicate with the laser means.

Another feature of the present invention is that a grade index optical means, a lensing means communicating with electronic driving means and laser means.

Yet another feature of the present invention is that a housing means of generally cylindrical shape such cylindrical shape containing modules for the laser means, signal processing means, piezoelectric means, and power module means.

Still another feature of the present invention is that a simulator barrel assembly into housing means is inserted and constrained.

Yet still another feature of the present invention is that a simulator barrel assembly and magazine that is colored "safety" orange to distinguish the simulator barrel and magazine from the "real" OEM barrel and magazine.

Still yet another feature of the present invention is that a simulator barrel assembly has warning labels as to the type of laser means housed in the simulator barrel assembly and the precautions thereto.

Another feature of the present invention is that the simulator barrel and magazine assemblies are designed to prevent the introduction of live ammunition into the breech of the firearm simulator.

Yet another feature of the present invention is that a magazine assembly can provide electrical energy and/or additional processing to the simulator barrel assembly.

Still another feature of the present invention is that the magazine assembly provides for logical, microprocessor, and/or microcontroller processing of electronic functions and related signals regardless of origin.

Yet still another feature of the present invention is that the magazine assembly provides analog processing of electronic functions and related signals regardless of origin.

Still yet another feature of the present invention is that the magazine assembly provides microprocessor and/or microcontroller processing of mechanical functions of the firearm simulator.

Another feature of the present invention is that the magazine assembly provides microprocessor and/or microcontroller processing of mechanical and electrical functions of the firearm simulator.

Yet another feature of the present invention is that the magazine assembly that provides microprocessor and/or microcontroller processing of mechanical and electrical functions and storage of these parameters in solid state memory.

Still another feature of the present invention is that the clip assembly provides electrical energy to the simulator barrel assembly.

Yet still another feature of the present invention is that the clip assembly provides microprocessor and/or microcontroller processing of electronic functions and related signals regardless of origin.

Still yet another feature of the present invention is that the clip assembly provides microprocessor and/or microcontroller processing of electronic functions and related signals regardless of origin.

Accordingly, it is a general object of the present invention to provide a generally tubular assembly that provides microprocessor and/or microcontroller processing of electrical and mechanical functions of the firearm simulator.

It is a more particular object of the present invention to provide a clip assembly that provides microprocessor and/or microcontroller processing of mechanical and electrical functions of the firearm simulator.

An object of the present invention is to provide a clip assembly that provides microprocessor and/or microcontroller processing of mechanical and electrical functions and storage of these parameters in solid state memory.

A further object of the present invention is to provide a means to use pulse code and/or frequency modulation of the laser means.

A still further object of the invention is to provide a signal processing means.

Yet still another feature of the present invention is that a battery power means is utilized as a power means.

Still yet another feature of the present invention is that a tubular assembly provides microprocessor and/or microcontroller processing of electrical signals and coding of laser means to transmit a plurality of different coded pulses.

Another feature of the present invention is that the battery power means is housed in a ammunition magazine configuration.

Yet another feature of the present invention is that the battery power means is housed in a ammunition clip configuration.

Still another feature of the present invention is that a microprocessor means is housed in a ammunition magazine configuration.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

COMMON COMPONENTS OF EMBODIMENTS

10—retrofittable laser system (10)
11—retrofittable housing (11)
11A—retrofittable housing groove (11A)
11B—retrofittable housing ring (11B)
12—laser module (12)
12A—laser module pin (12A)
12B—laser module ridge (12B)
12C—laser module light pulse (12C)
12D—laser module graded index optics (12D)
12E—laser module diode (12E)

12EA—laser module diode driver circuit (12EA)
12F—laser module focus adjustment (12F)
14—processor module (14)
14A—first processor module (14A)
14AA—first processor module first pin receptacle (14AA)
14AB—first processor module second pin receptacle (14AB)
14AC—first processor module ridge (14AC)
14B—second processor module (14B)
14BA—second processor module pin (14BA)
14BB—second processor module pin receptacle (14BB)
14BC—second processor module ridge (14BC)
16—piezo module (16)
16A—piezo module pin (16A)
16B—piezo module pin receptacle (16B)
16C—piezo module ridge (16C)
16D—piezo module switch (16D)
18—power module (18)
18A—first power module (18A)
18AA—first power module electronic connector pin (18AA)
18AB—first power module electronic connector pin receptacle (18AB)
18AC—first power module electronic ridge (18AC)
18B—second power module (18B)
18BA—second power module electronic connector pin (18BA)
18BB—second power module electronic connector pin receptacle (18BB)
18BC—second power module electronic ridge (18BC)
18C—power module spacer (18C) (not shown)
18CA—power module spacer pin (18CA) (not shown)
18CB—power module spacer pin receptacle (18CB) (not shown)
22A—first cable/connector (22A)
22AA—first cable/connector power module adaptor (22AA)
22AAA—first cable/connector power module adaptor pin receptacle (22AAA)
22AB—first cable/connector piezo module adaptor (22AB)
22ABA—first cable/connector piezo module adaptor pin (22ABA)
22B—second cable/connector (22B)
22BA—second cable/connector first power module adaptor (22BA)
22BAA—second cable/connector first power module adaptor pin receptacle (22BAA)
22BB—second cable/connector second power module adaptor (22BB)
22BBA—second cable/connector second power module adaptor pin receptacle (22BBA)
22BC—second cable/connector piezo module adaptor (22BC)
22BCA—second cable/connector piezo module adaptor pin (22BCA)
22D—cable/connector line (22D)
24—pistol (24)
24A—pistol housing (24A)
24B—pistol barrel (24B)
24BA—pistol barrel bore (24BA)
24C—pistol ammunition magazine (24C)
24D—pistol ammunition chamber (24D)
24E—pistol firing pin (24E)
24F—pistol firing trigger (24F)
25—gas cylinder (25)
26A—communications module (26A)
FIRST FIREARM EMBODIMENT
124—pistol (124)
124A—pistol housing (124A)
124B—pistol barrel (124B)
124BA—pistol barrel bore (124BA)
124C—pistol ammunition magazine (124C)
124CA—first pistol ammunition magazine (124CA)
124CB—second pistol ammunition magazine (124CB)
124CBA—second pistol ammunition magazine single power module chamber (124CBA)
124CC—third pistol ammunition magazine (124CC)
124CCA—third pistol ammunition magazine double power module chamber (124CCA)
124CD—forth pistol ammunition magazine (124CD)
124CDA—forth pistol ammunition magazine double power module chamber (124CDA)
124CDB—forth pistol ammunition magazine gas cylinder chamber (124CDB)
124CDBA—forth pistol ammunition magazine gas cylinder chamber cap (124CDBA)
124CDBAA—forth pistol ammunition magazine gas cylinder chamber cap point (124CDBAA)
124CDC—forth pistol ammunition magazine gas pre-chamber (124CDC)
124CDCA—forth pistol ammunition magazine gas pre-chamber first switch (124CDC)
124CDCB—forth pistol ammunition magazine gas pre-chamber second switch (124CDCB)
124CDD—forth pistol ammunition magazine gas expansion chamber (124CDD)
124CDDA—forth pistol ammunition magazine gas expansion chamber port (124CDDA)
124CDDB—forth pistol ammunition magazine gas expansion chamber anvil (124CDDB)
124CDDC—forth pistol ammunition magazine gas expansion chamber return means (124CDDC)
124CDDD—forth pistol ammunition magazine gas expansion chamber stopper (124CDDD)
124D—pistol ammunition magazine chamber (124D)
124E—pistol firing pin (124E)
124F—pistol firing trigger (124F)
SECOND FIREARM EMBODIMENT
224—machine gun (224)
224A—machine gun housing (224A)
224B—machine gun barrel (224B)
224BA—machine gun barrel bore (224BA)
224C—machine gun ammunition magazine (224C)
224D—machine gun ammunition magazine chamber (224D)
224E—machine gun firing pin (224E)
224F—machine gun firing trigger (224F)
THIRD FIREARM EMBODIMENT
324—shotgun (324)
324A—shotgun housing (324A)
324B—shotgun barrel (324B)
324BA—shotgun barrel bore (324BA)
324C—shotgun ammunition magazine (324C)
324CB—shotgun ammunition magazine gas cylinder chamber (324CB)
324CBA—shotgun ammunition magazine gas cylinder chamber cap (324CBA)
324CBAA—shotgun ammunition magazine gas cylinder chamber cap point (324CBAA)
324CC—shotgun ammunition magazine gas pre-chamber (324CC)
324CCA—shotgun ammunition magazine gas pre-chamber first switch (324CCA)
324CCB—shotgun ammunition magazine gas pre-chamber second switch (324CCB)
324CD—shotgun ammunition magazine gas expansion chamber (324CD)

324CDA—shotgun ammunition magazine gas expansion chamber port (324CDA)

324CDB—shotgun ammunition magazine gas expansion chamber anvil (324CDB)

324CDC—shotgun ammunition magazine gas expansion chamber return means (324CDC)

324CDD—shotgun ammunition magazine gas expansion chamber stopper (324CDD)

324D—shotgun ammunition magazine chamber (324D)

324E—shotgun firing pin (324E)

324F—shotgun firing trigger (324F)

DESCRIPTION OF THE PREFERRED EMBODIMENT

Figure 1:
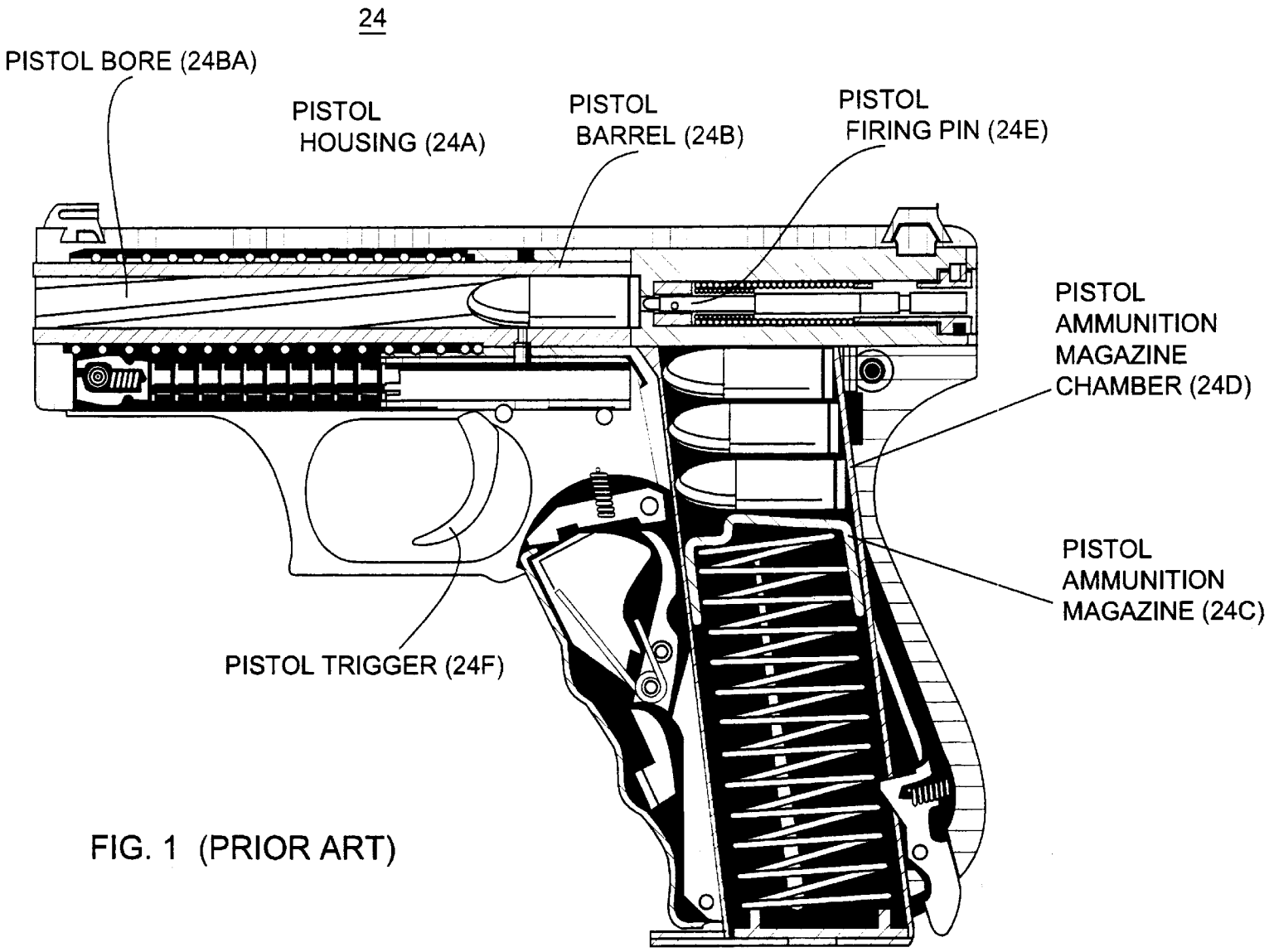
FIG. 1 (PRIOR ART)
FIG. 1 is a cross-sectional view of a prior art pistol exhibiting a standard barrel with an internal bore, a trigger mechanically communicating with a hammer (not shown) and firing pin or striker, ammunition magazine chamber and ammunition magazine.

Firstly, referring to FIG. 1 which is a cross-sectional view of a prior art pistol (24) having a pistol housing (24A) within which a standard pistol barrel (24B) with an internal pistol barrel bore (24BA), a pistol firing trigger (24F) which communicates with a hammer and pistol firing pin (24E), an pistol ammunition chamber (24D) containing a pistol ammunition magazine (24C) therein. The standard barrel and the ammunition magazine are easily and rapidly removable.

Figure 2A:
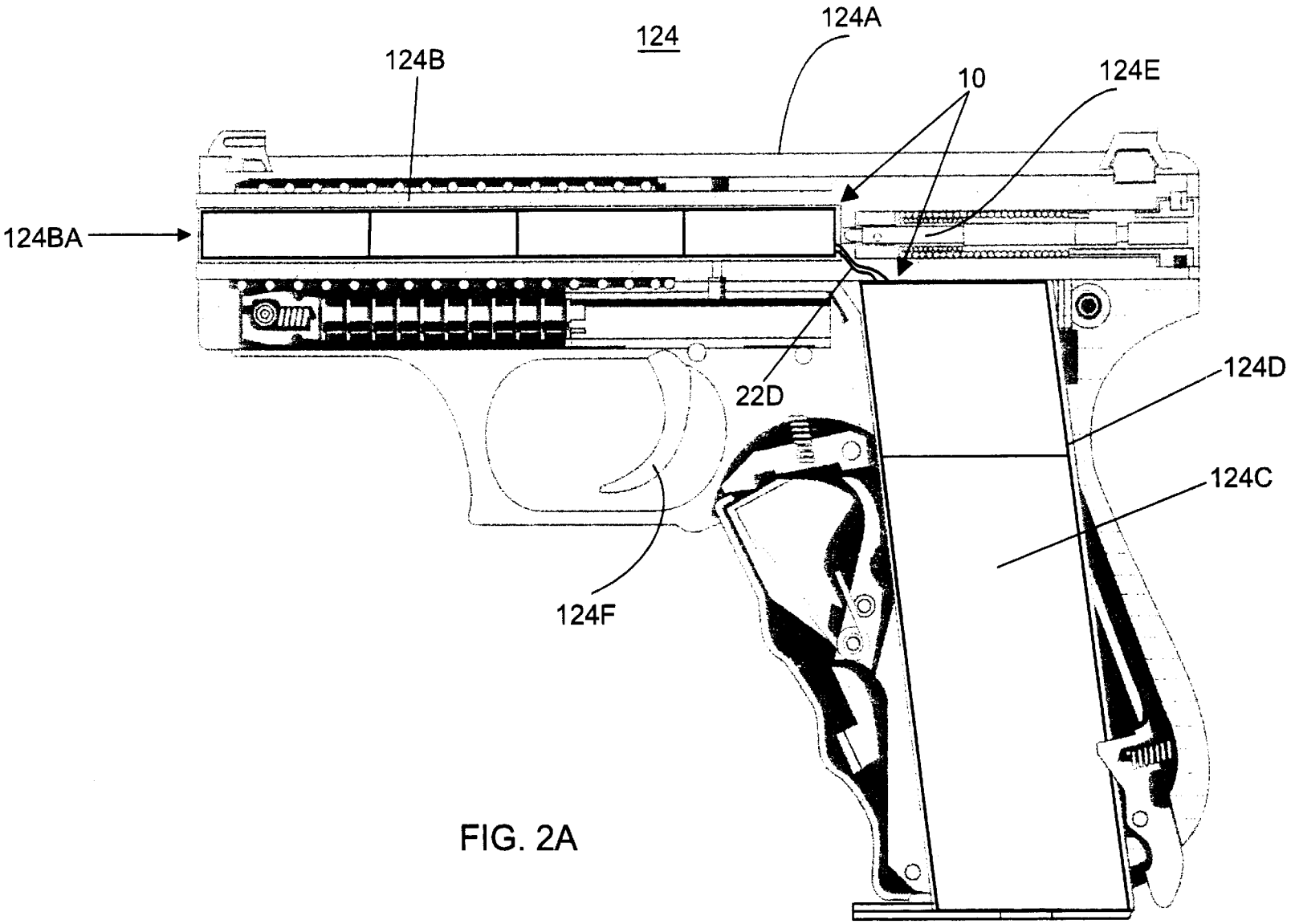
FIG. 2A is cross-sectional view of the prior art pistol exhibiting a retrofittable laser system integrated into a retrofitted pistol barrel and a retrofitted pistol ammunition magazine.

Referring to FIG. 2A which is a cross-sectional view of the pistol (124) having a pistol housing (124A) exhibiting a retrofittable laser system (10) integrated into a retrofitted pistol barrel (124B) and a retrofitted pistol ammunition magazine (124C). When the retrofittable laser system (10) is installed, the standard barrel as exhibited in FIG. 1 is removed and the pistol barrel (124B) is inserted therein. If the power module (18) is located in the pistol ammunition magazine (124C), the standard ammunition magazine is removed and the pistol ammunition magazine (124C) into the pistol ammunition magazine chamber (124D). When a user pulls the pistol firing trigger (124F), the pistol firing pin (124E) is released which results in a laser module light pulse (12C) emission from a distal end of the pistol barrel (124B).

Figure 2B:
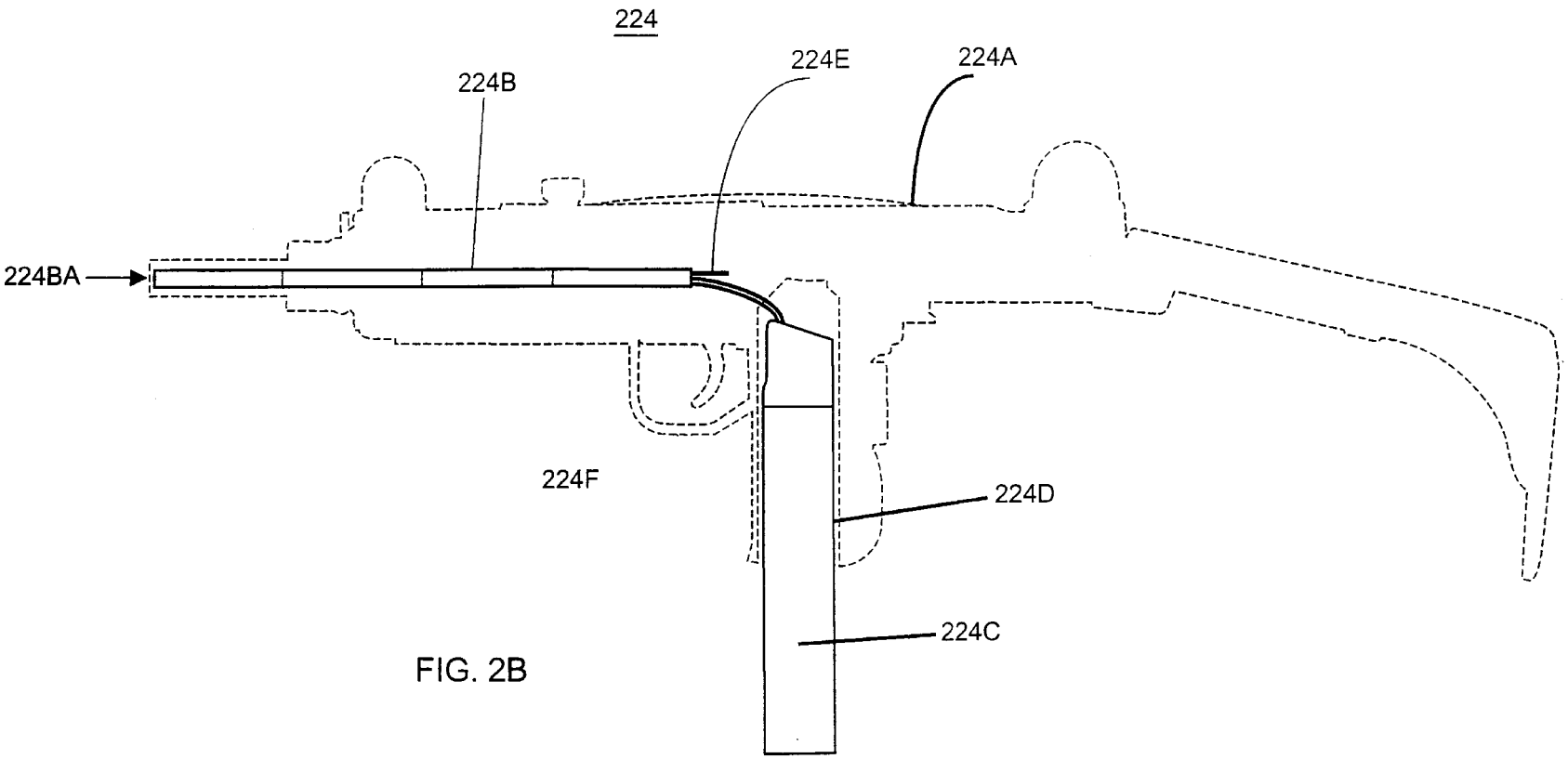
FIG. 2B is a machine gun exhibiting a retrofittable laser system integrated into a retrofitted machine gun barrel and a retrofitted machine gun ammunition magazine.

Now referring to FIG. 2B which is a machine gun (224) having a machine gun housing (224A) within which a retrofittable laser system (10) is retrofittably integrated into a machine gun barrel bore (224BA) of a machine gun barrel (224B). A retrofitted machine gun ammunition magazine (224C) is inserted into a machine gun ammunition magazine chamber (224D). When a user pulls the machine gun firing trigger (224F), the machine gun firing pin (224E) is released which results in a laser module light pulse (12C) emission from a distal end of the machine gun barrel (224B).

Figure 2C:
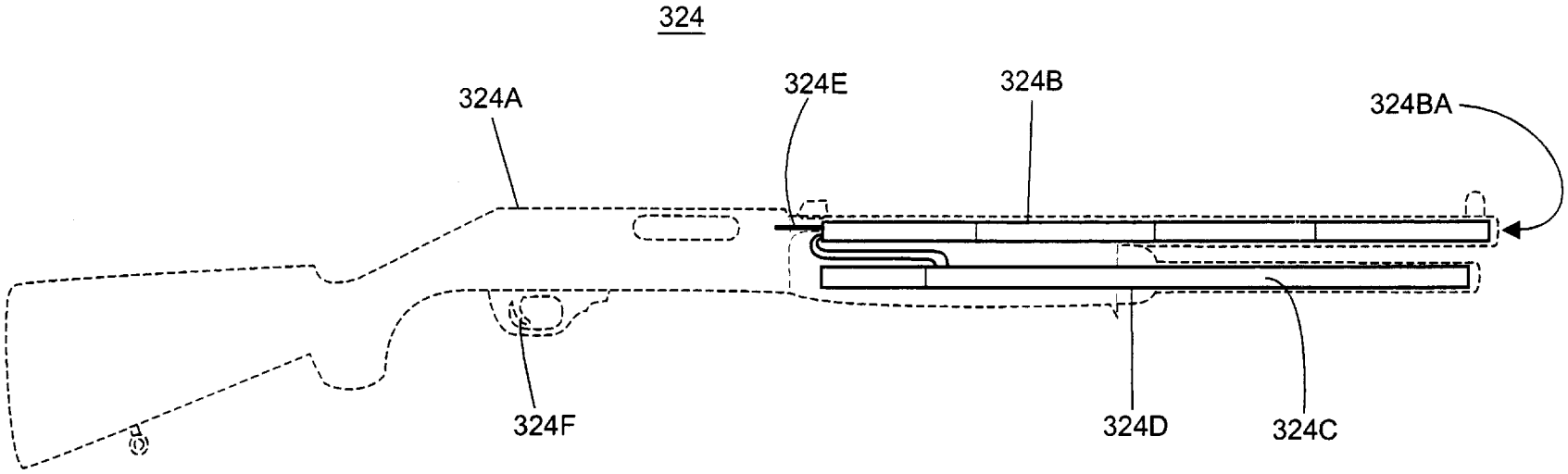
FIG. 2C is a shotgun exhibiting a retrofittable laser system integrated into a retrofitted shotgun barrel and a retrofitted shotgun ammunition magazine which is tube-like in configuration.

Referring to FIG. 2C which is a shotgun (324) having a shotgun housing (324A) within which a retrofittable laser system (10) is retrofittably integrated into a shotgun barrel bore (324BA) of a shotgun barrel (324B) which is tube-like in configuration. A retrofitted shotgun ammunition magazine (324C) is inserted into a shotgun ammunition magazine chamber (324D). When a user pulls the shotgun firing trigger (324F), the shotgun firing pin (324E) is released which results in a laser module light pulse (12C) emission from a distal end of the shotgun barrel (324B).

Figure 3:
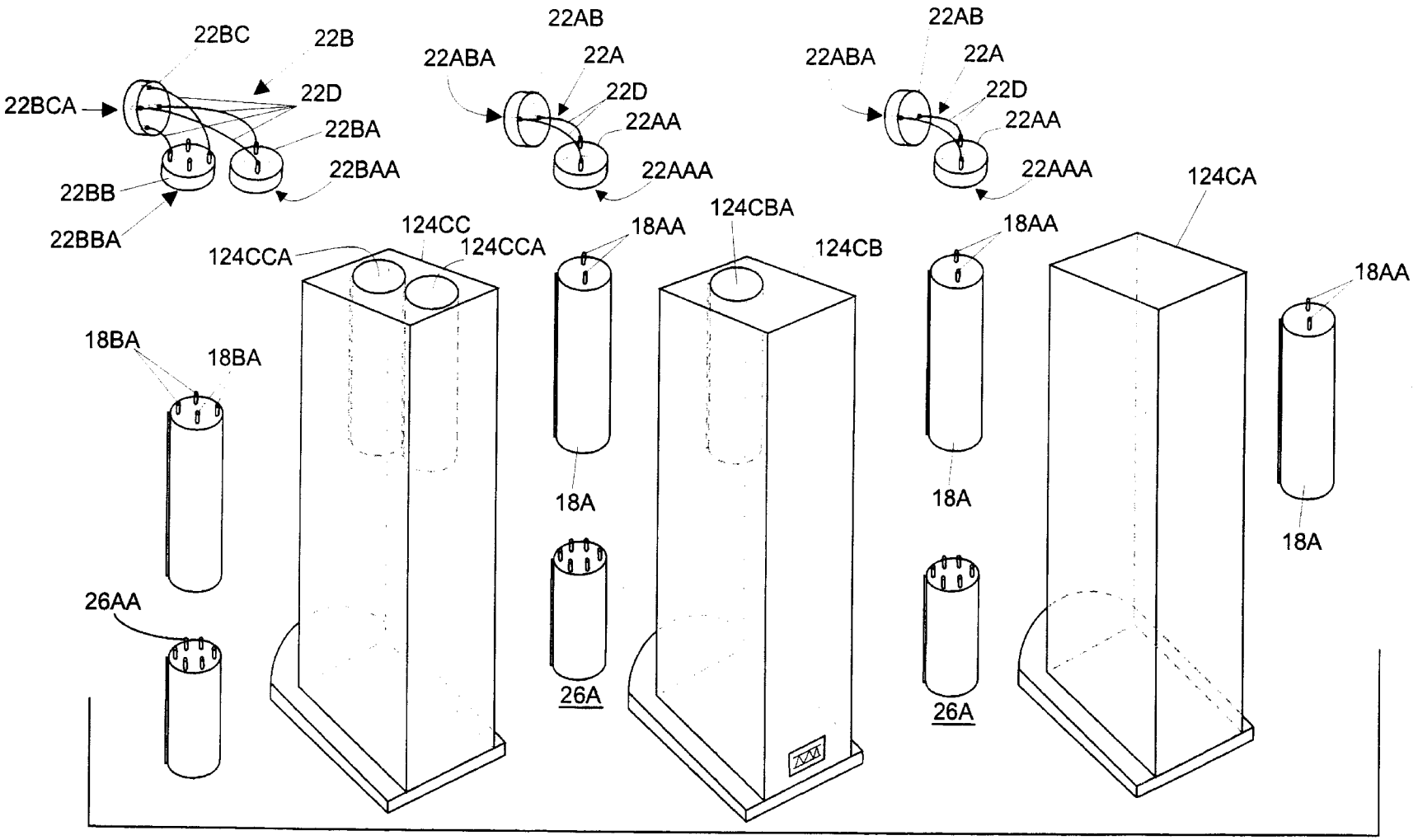
FIG. 3 are top right perspective views of three different embodiments of pistol ammunition magazine which are a first pistol ammunition magazine, a second pistol ammunition magazine, and a second pistol ammunition magazine single power module chamber.

Referring to FIG. 3 which are top right perspective views of three different embodiments of pistol ammunition magazine (124C) which are a first pistol ammunition magazine (124CA), a second pistol ammunition magazine (124CB), and a second pistol ammunition magazine single power module chamber (124CBA). The first pistol ammunition magazine (124CA) is a standard pistol ammunition magazine without ammunition. The first power module (18A) is incorporated into the retrofittable laser system (10) within the pistol barrel bore (124BA) of the pistol barrel (124B) having a similar weight, weight distribution and feel as the standard pistol barrel.

The second pistol ammunition magazine (124CB) has a first power module (18A) positioned within a second pistol ammunition magazine single power module chamber (124CBA). The first power module (18A) is electronically coupled to another first power module (18AA) or directly to a piezo module (16) by a cable/connector (22) which is a first cable/connector (22A). The another first power module (18A) or the piezo module (16) are positioned in the pistol barrel (124B). The first cable/connector (22A) comprises a first cable/connector power module adaptor (22AA) having at least one first cable/connector power module adaptor pin receptacle (22AAA) therein which is electronically connected by a cable/connector line (22D) to at least one first cable/connector piezo module adaptor pin (22ABA) positioned on a first cable/connector piezo module adaptor (22AB). The first power module (18A) has at least two first power module electronic connector pin (18AA) which is insertable into and electronically connectable to the at least one first cable/connector power module adaptor pin receptacle (22AAA). The piezo module (16) has at least one piezo module pin receptacle (16B) which is insertable into and electronically connectable to the at least one first cable/connector piezo module adaptor pin (22ABA). The retrofittable laser system (10) further comprises a communications module (26A) electrically connected to the processor module (14). The communications module (26A) provides for a wireless or wired communications link between the simulator weapon and a receiver which may be another computer, microprocessor/microcontroller, display means, or human interface (audio or visual). The communications module in the weapon simulator provides the means to transmit audio and visual information and a variety of data related to the electronic and mechanical functions of the weapon simulator; i.e., operational status of electronic and mechanical functions such as number of shots fired, magazine in/out, weapon ready to fire, weapon on safety, laser power, user status such as killed or wounded by a hostile laser shot, and others.

The communications module in the weapon simulator also receives audio and visual information and data from a remote transmitter which communicates with a computer, microprocessor/microcontroller, display, and human interface means. The remote transmitter means provides data and commands related to the functionality of the weapon simulator; i.e., alters the functionality of the weapon simulator; weapon ready to fire command, jams the weapon in single or multiple malfunction modes, and disables the weapon if the weapon simulator user has been "killed" by a hostile laser shot, and functionally related data."

The third pistol ammunition magazine (124CC) comprises a first power module (18A) and a second power module (18B) positioned within third pistol ammunition magazine double power module chambers (124CCA). The second power module (18B) has at least one second power module electronic connector pin (18BA) which is insertable into at least one second cable/connector second power module adaptor pin receptacle (22BBA) of a second cable/connector second power module adaptor (22BB) of a second cable/connector (22B). The at least one second cable/connector second power module adaptor pin receptacle (22BBA) is electrically connected by a cable/connector line (22D) to at least one second cable/connector piezo module adaptor pin (22BCA) of a second cable/connector piezo module adaptor (22BC). The at least one first power module electronic connector pin (18AA) of the first power module (18A) is insertable into at least one second cable/connector first power module adaptor pin receptacle (22BAA) of a second cable/connector first power module adaptor (22BA). The at least one second cable/connector first power module adaptor pin receptacle (22BAA) is electrically connected to the at least one second cable/connector piezo module adaptor pin (22BCA) by a cable/connector line (22D). The at least one second cable/connector piezo module adaptor pin (22BCA) is insertable into and electrically connectable to the at least one first power module electronic connector pin receptacle (18AB) of the first power module (18A) which is positioned within a gun barrel or the at least one piezo module pin receptacle (16B). The retrofittable laser system (10) further comprises a communications module (26A) electrically connected to the processor module (14).

Figure 4:
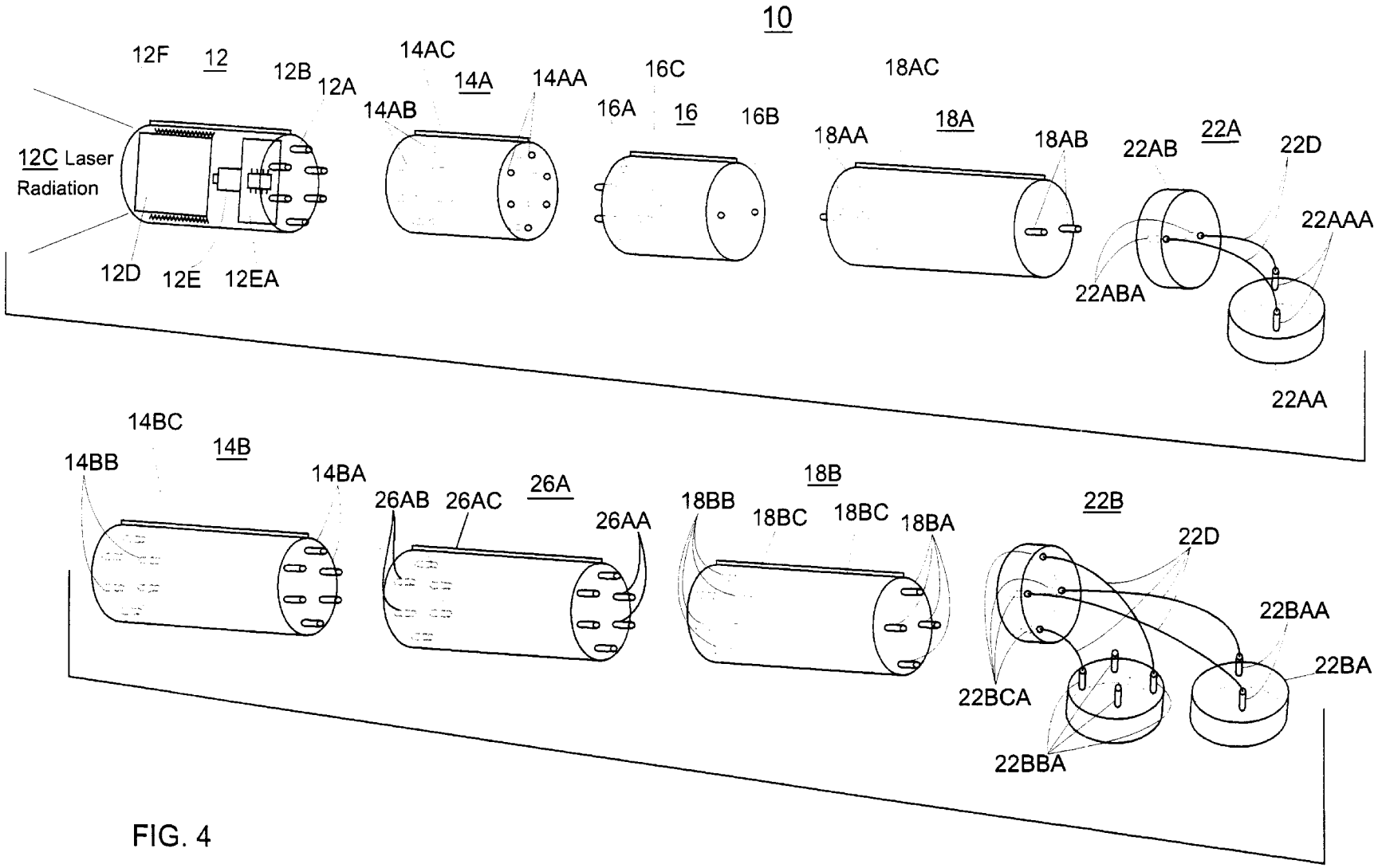
FIG. 4 is a perspective view of various components of the retrofittable laser system comprising a laser module, a first processor module, a second processor module, a piezo module, a first power module, a second power module, a first cable/connector, and a second cable/connector.

FIG. 4 is a perspective view of various components of the retrofittable laser system (10) comprising a laser module (12), a first processor module (14A), a second processor module (14B), a piezo module (16), a first power module (18A), a second power module (18B), a first cable/connector (22A), and a second cable/connector (22B). The at least one first cable/connector piezo module adaptor pin (22ABA) is insertable into the at least one first power module electronic connector pin receptacle (18AB) of the first power module (18A). The at least one first power module electronic connector pin (18AA) is insertable into the at least one piezo module pin receptacle (16B) of the piezo module (16) forming an electronic connection there between. The piezo module (16) has at least one piezo module pin (16A) which is insertable into at least one first processor module first pin receptacle (14AA) of a first processor module (14A) forming an electronic connection there between. The first processor module (14A) has at least one first processor module second pin receptacle (14AB) within which at least one laser module pin (12A) of a laser module (12) is insertable forming an electronic connection there between. The piezo module (16) sends an electronic signal to the signal processing module which in turn sends an electronic signal to the laser module (12) which activates a laser module diode driver circuit (12EA) of a laser module diode (12E) thus emitting a laser module light pulse (12C) through a laser module graded index optics (12D). A laser module focus adjustment (12F) can manually fine tune the emitted laser module light pulse (12C). The retrofittable laser system (10) further comprises a communications module (26A) electrically connected to the processor module (14).

A second power module (18B) can be electronically substituted for or linked in parallel with the first power module (18A). The second power module (18B) has at least one second power module electronic connector pin receptacle (18BB) within which ate least one second cable/connector piezo module adaptor pin (22BCA) is insertable and electrically connectable therein. The at least one second power module electronic connector pin (18BA) is insertable into the at least one first power module electronic connector pin receptacle (18AB) or the at least one piezo module pin receptacle (16B).

The first processor module (14A) can be substituted or electronically coupled in parallel with a second processor module (14B). The second processor module (14B) has at least one second processor module pin (14BA) and at least one second processor module pin receptacle (14BB). If the second processor module (14B) is linked in parallel with the first processor module (14A), the at least one second processor module pin (14BA) is insertable into the at least one first processor module second pin receptacle (14AB). The at least one second processor module pin receptacle (14BB) receives the at least one piezo module pin (16A). A power module spacer (18C) (not shown) which resembles a second power module (18B) in appearance may be inserted in parallel with the first power module (18A) in a similar configuration as described herein above. The power module spacer (18C) (not shown) has at least one power module spacer pin (18CA) (not shown) and at least one power module spacer pin receptacle (18CB) (not shown) which function identically to the at least one second power module electronic connector pin (18BA) and the at least one second power module electronic connector pin receptacle (18BB), respectively. The primary difference between the second power module (18B) and the power module spacer (18C) (not shown) is that the second power module (18B) contains a power source such as a battery therein.

The laser module (12) has a laser module ridge (12B) extending therefrom. The first processor module (14A) has a first processor module ridge (14AC) extending therefrom. The second processor module (14B) has a second processor module ridge (14BC) extending therefrom. The piezo module (16) has a piezo module ridge (16C)extending therefrom. The first power module (18A) has a first power module electronic ridge (18AC) extending therefrom. The second power module (18B) has a second power module electronic ridge (18BC) extending therefrom.

Figure 5:
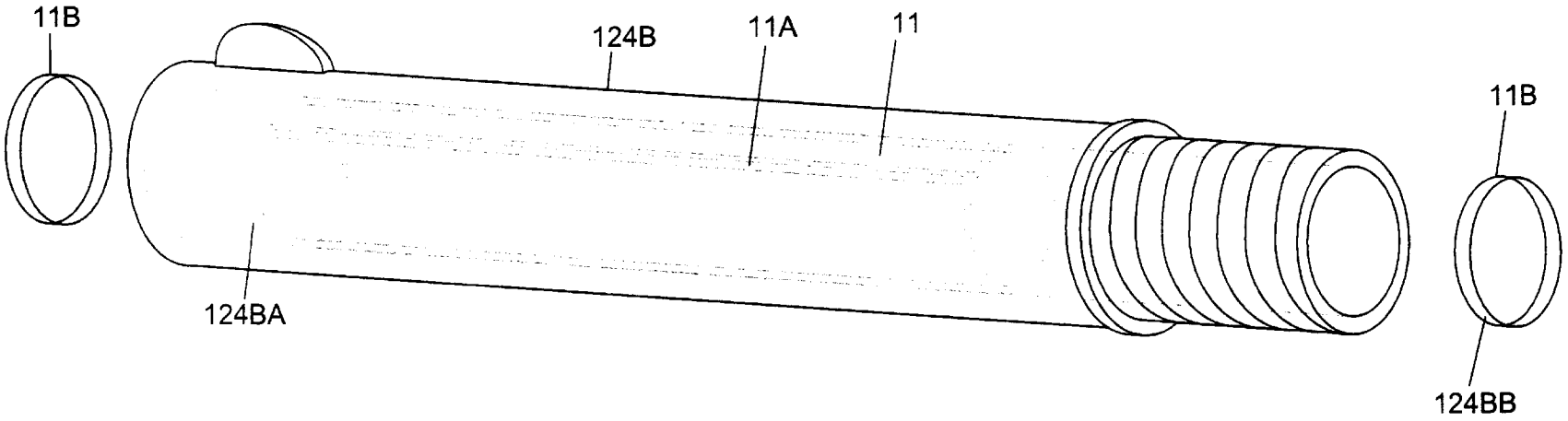
FIG. 5 is a perspective view of a pistol barrel.

Referring to FIG. 5 which is a perspective view of a pistol barrel (124B) containing a retrofittable housing (11) therein.

The retrofittable housing (11) has a retrofittable housing groove (11A) longitudinally disposed therein. The laser module ridge (12B), the first processor module ridge (14AC), the first processor module ridge (14AC), the piezo module ridge (16C), the first power module electronic ridge (18AC) and/or the second power module electronic ridge (18BC) are slidably insertable within the retrofittable housing groove (11A). A retrofittable housing ring (11B) is positioned on opposite sides of the retrofittable laser system (10) within the bore of the barrel. The retrofittable laser system (10) further comprises a communications module (26A) electrically connected to the processor module (14).

Figure 6A:
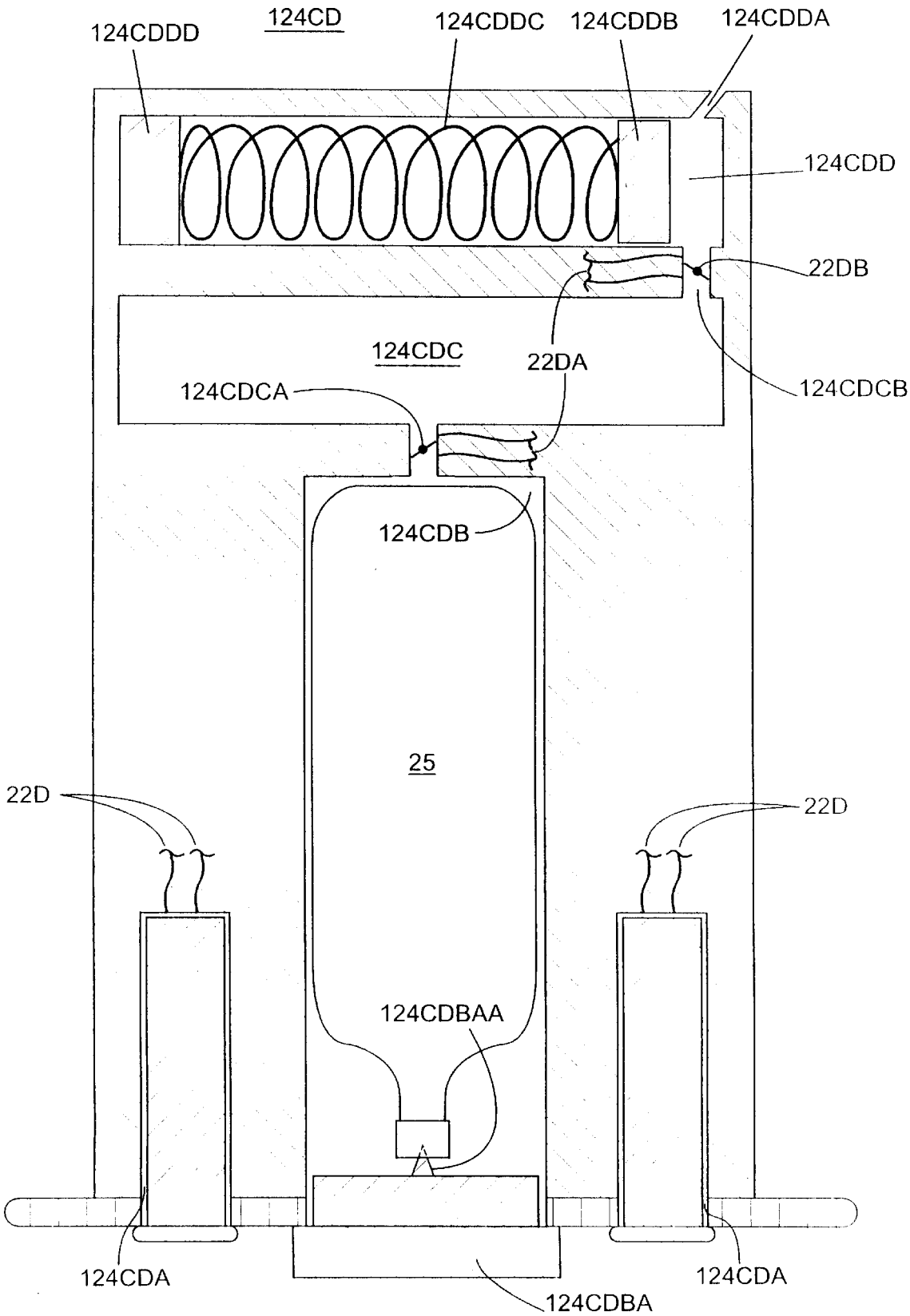
FIG. 6A is a cross-sectional view of a forth pistol ammunition magazine.

Referring to FIG. 6A which is a cross-sectional view of a forth pistol ammunition magazine (124CD). The forth pistol ammunition magazine (124CD) is similar to the second pistol ammunition magazine single power module chamber (124CBA). The recoil module (20) comprises a forth pistol ammunition magazine gas cylinder chamber (124CDB) within which a gas cylinder (25) is removably inserted therein. Preferably, the forth pistol ammunition magazine gas cylinder chamber (124CDB) has a forth pistol ammunition magazine gas cylinder chamber cap (124CDBA) with a forth pistol ammunition magazine gas cylinder chamber cap point (124CDBAA) extending therefrom. When a user inserts the gas cylinder (25) into the forth pistol ammunition magazine gas cylinder chamber (124CDB) and tightly screws in the forth pistol ammunition magazine gas cylinder chamber cap (124CDBA), the forth pistol ammunition magazine gas cylinder chamber cap point (124CDBAA) pierces the gas cylinder (25) releasing pressured gas therein. A forth pistol ammunition magazine gas pre-chamber first switch (124CDC) is then activated to allow a predetermined amount of the pressurized gas into a forth pistol ammunition magazine gas pre-chamber (124CDC). After the predetermined amount of the pressurized gas enters the forth pistol ammunition magazine gas pre-chamber (124CDC) the forth pistol ammunition magazine gas pre-chamber first switch (124CDC) is closed. When the user pulls a pistol firing trigger (24F), the pistol firing pin (24E) is activated which concurrently sends an electronic signal to the laser module (12) emitting a laser module light pulse (12C) from a distal end of the pistol barrel (24B). Concurrently, a forth pistol ammunition magazine gas pre-chamber second switch (124CDCB) is activated allowing the predetermined amount of the pressurized gas to escape from the forth pistol ammunition magazine gas pre-chamber (124CDC) to a forth pistol ammunition magazine gas expansion chamber (124CDD) which rapidly pushes a forth pistol ammunition magazine gas expansion chamber anvil (124CDDB) in a direction of a forth pistol ammunition magazine gas expansion chamber stopper (124CDDD) firmly striking it causing a recoil effect. A forth pistol ammunition magazine gas expansion chamber return means (124CDDC) returns the forth pistol ammunition magazine gas expansion chamber anvil (124CDDB) back to position while the expanded gas escapes through a forth pistol ammunition magazine gas expansion chamber port (124CDDA).

Figure 6B:
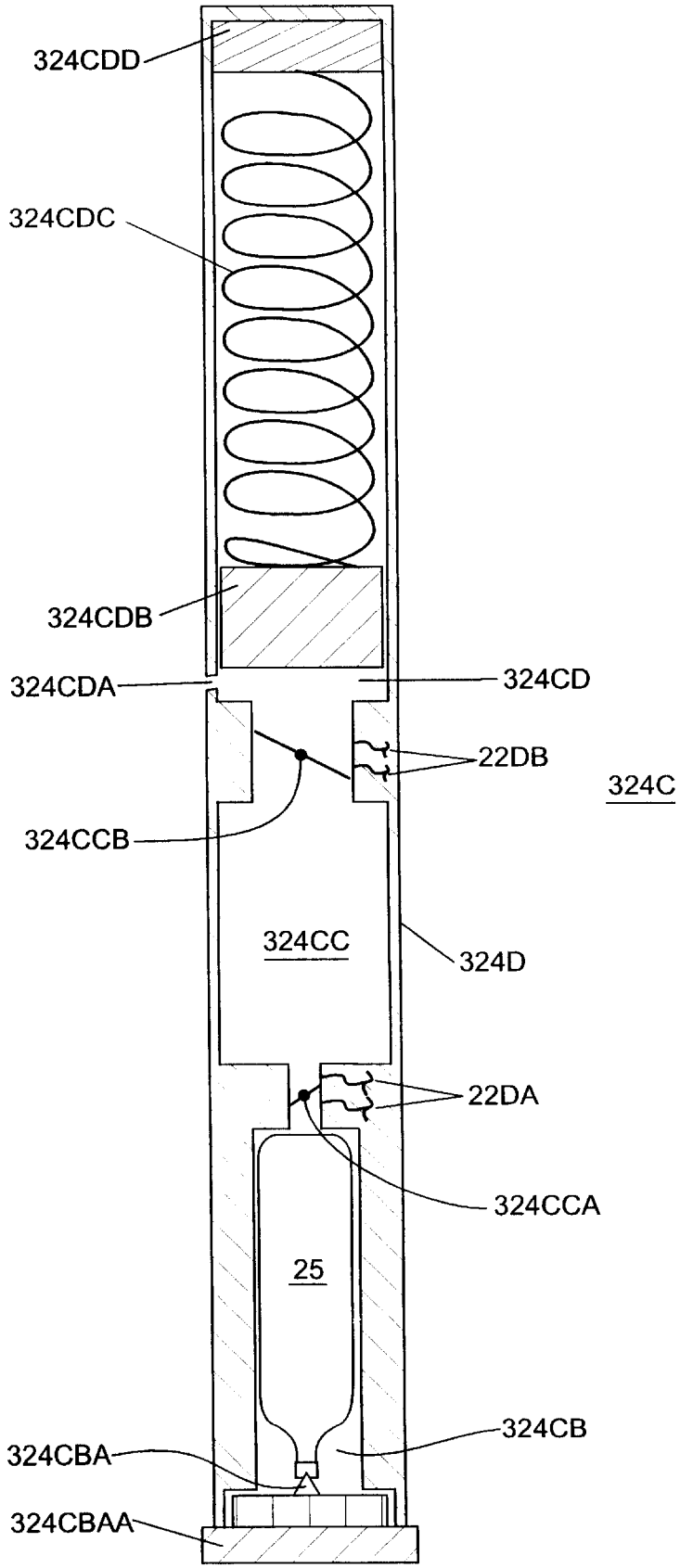
FIG. 6B is a cross-sectional view of a shotgun ammunition magazine which is tube-like in configuration.

Referring to FIG. 6B which is a cross-sectional view of a shotgun ammunition magazine (324C). In a similar functional configuration to the forth pistol ammunition magazine (124CD), The recoil module (20) comprises a shotgun ammunition magazine gas cylinder chamber (324CB) within a shotgun ammunition magazine chamber (324D). A gas cylinder (25) is removably inserted or recharged within the shotgun ammunition magazine gas cylinder chamber (324CB). Preferably, the shotgun ammunition magazine gas cylinder chamber (324CB) has a shotgun ammunition magazine gas cylinder chamber cap (324CBA) with a shotgun ammunition magazine gas cylinder chamber cap point (324CBAA) extending therefrom. When a user inserts the gas cylinder (25) into the shotgun ammunition magazine gas cylinder chamber (324CB) and tightly screws in the shotgun ammunition magazine gas cylinder chamber cap (324CBA), the shotgun ammunition magazine gas cylinder chamber cap point (324CBAA) pierces the gas cylinder (25) releasing pressured gas therein. A shotgun ammunition magazine gas pre-chamber first switch (324CC) is then activated to allow a predetermined amount of the pressurized gas into a shotgun ammunition magazine gas pre-chamber (324CC). After the predetermined amount of the pressurized gas enters the shotgun ammunition magazine gas pre-chamber (324CC), the shotgun ammunition magazine gas pre-chamber first switch (324CC) is closed. When the user pulls a shotgun firing trigger (324F), the shotgun firing pin (324E) is activated which concurrently sends an electronic signal to the laser module (12) emitting a laser module light pulse (12C) from a distal end of the pistol barrel (24B). Concurrently, a shotgun ammunition magazine gas pre-chamber second switch (324CCB) is activated allowing the predetermined amount of the pressurized gas to escape from the shotgun ammunition magazine gas pre-chamber (324CC) to a shotgun ammunition magazine gas expansion chamber (324CD) which rapidly pushes a shotgun ammunition magazine gas expansion chamber anvil (324CDB)in a direction of a shotgun ammunition magazine gas expansion chamber stopper (324CDD) firmly striking it causing a recoil effect. A shotgun ammunition magazine gas expansion chamber return means(324CDC) returns the shotgun ammunition magazine gas expansion chamber anvil (324CDB) back to position while the expanded gas escapes through a shotgun ammunition magazine gas expansion chamber port (324CDA).

Figure 7:
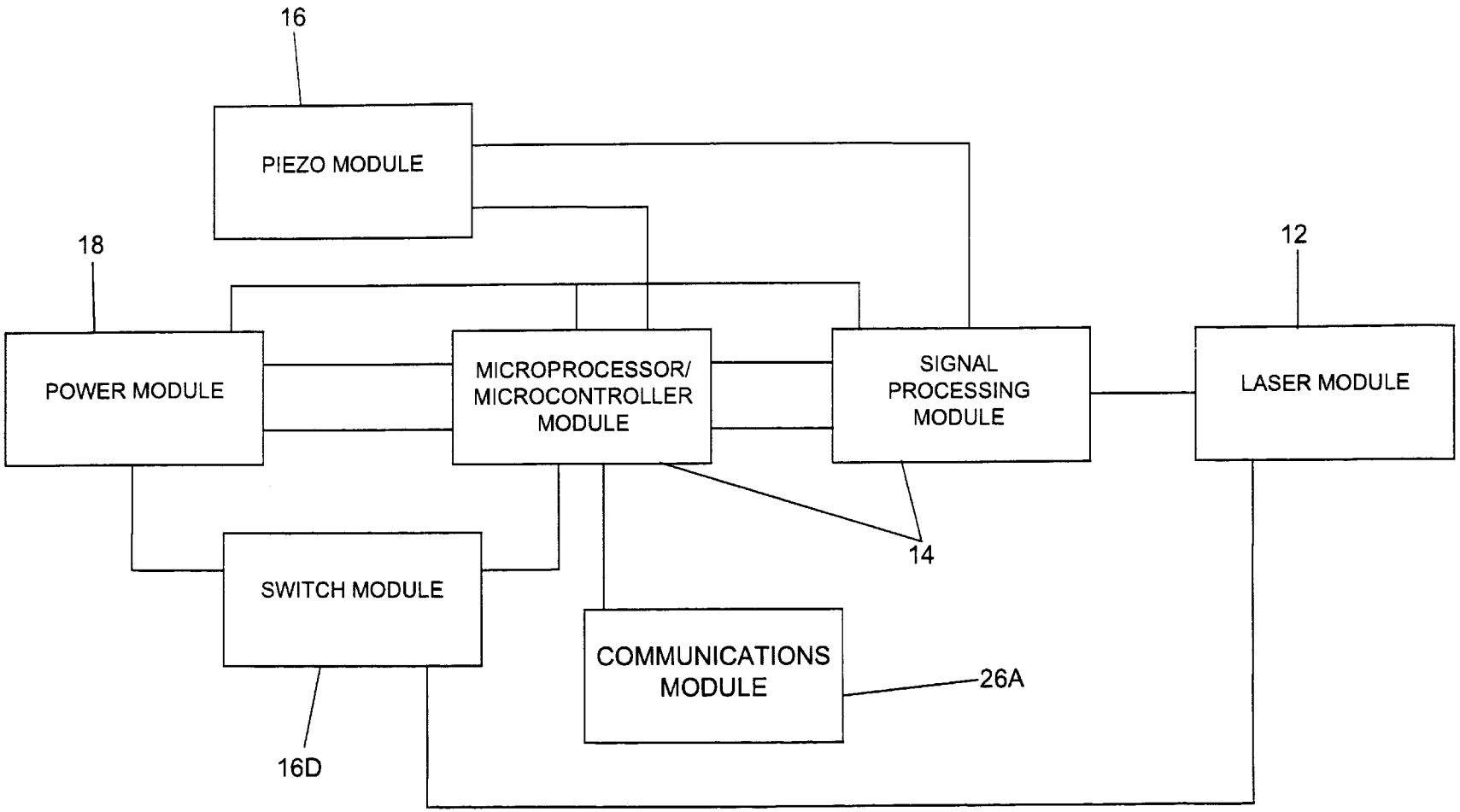
FIG. 7 is a diagrammatic representation of the retrofittable laser system.

Now referring to FIG. 7 is a diagrammatic representation of the retrofittable laser system (10). The piezo module (16) is electronically connected to the processor module (14) which is composed of a microprocessor/microcontroller module and a signal processing module. The signal processing module is electrically connected to the microprocessor/microcontroller module and a laser module (12). The laser module (12) is electrically connected to a piezo module switch (16D) which is electrically connected to a power module (18) and the microprocessor/microcontroller module. The microprocessor/microcontroller module is further electrically connected to the power module (18) and the piezo module (16).The retrofittable laser system (10) further comprises a communications module (26A) electrically connected to the processor module (14). When a user pulls the pistol firing trigger (24F) releasing the pistol firing pin (24E), the piezo module switch (16D) is activated sending an electrical impulse from the power module (18) to the microprocessor/microcontroller module which in turn sends an electronic signal to the piezo module (16) and the signal processing module. The piezo module (16) send an electronic signal to the signal processing module which in turn send an electronic signal to the laser module (12) which activates a laser module diode driver circuit (12EA) of a laser module diode (12E) thus emitting a laser module light pulse (12C) through a laser module graded index optics (12D). A laser module focus adjustment (12F) can manually fine tune the emitted laser module light pulse (12C).

Figure 8:
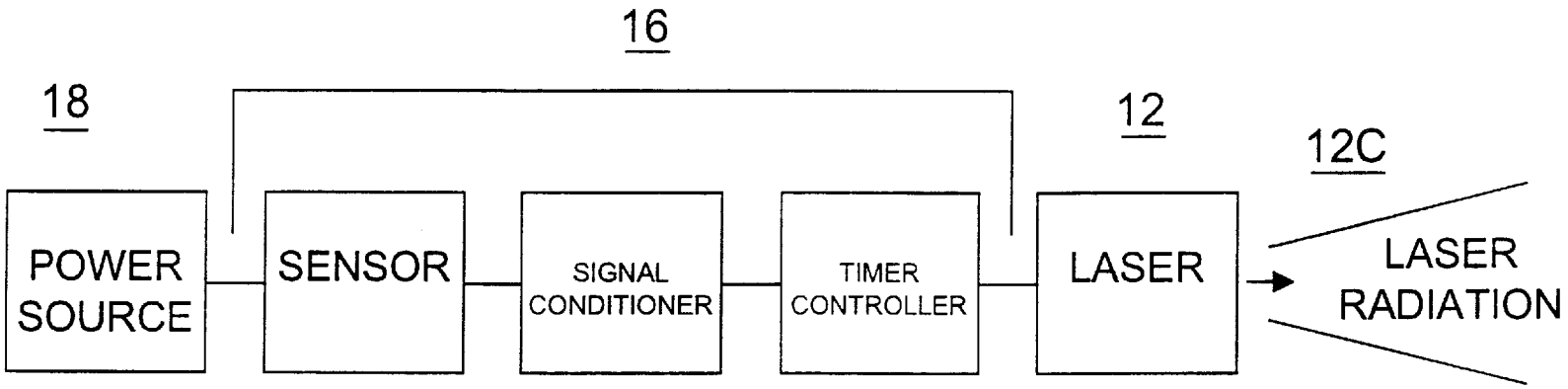
FIG. 8 is a diagrammatic representation of the functionality of the retrofittable laser system.

Referring to FIG. 8 which is a diagrammatic representation of the functionality of the retrofittable laser system (10) comprising a power module (18) which may be preferably either a rechargeable or non-rechargeable battery or may be optionally an AC or DC source. In the AC source embodiment, it would be rectified to provide appropriate DC voltages. The retrofittable laser system (10) further comprises a sensor consisting of a piezo module (16), a piezo module switch (16D), and a piezo module sensor. A signal conditioner functions to filter non-firing pulses from the piezo module (16) and permit only correct electrical signals to initiate firing of the laser. The piezo module switch (16D) invariable have problems with bounce. The piezo module switch (16D) may create a switch function signal by the design and function of the switch. This erroneous switch closure signal would also cause activation of the laser module (12) as a reaction to bounce rather than in response to being hit by the pistol firing pin (24E). The signal conditioner performs a similar filtering function as above.

Where applicable, amplification would also be a component of the signal conditioning to provide for a signal amplification to meet retrofittable laser system (10) requirements and also provide the timer controller with required signal levels. The signal conditioner, as applicable, provides for shaping the wave form in terms of signal inversion, shaping digital signals to assure proper input to the timer controller, and shaping analog signals to conform to signal formats. Analog to digital and digital to analog conversion are important when interfaced either to digital or analog interfaces. In general, the signal conditioner would perform broad electronic functions to meet generalized or specific requirements for the multiplicity of implementations.

The general purpose of the timer controller is to provide a minimum means to trigger a laser module light pulse (12C) and set the pulse width (on time) of the laser module light pulse (12C). In more general terms, the timer controller provides a variety of functions such as:

A) means to trigger the laser pulse

B) means to set the pulse width of the laser pulse

C) means to modulate the laser pulse

D) means to code the laser pulse by using a multiplicity of coding techniques

E) means to control laser output

F) means to control general power consumption of all electronic functions contained with the laser module concept G) means to count the number of laser pulses fired H) means to read and write data into memory I) means to trigger laser pulses in accordance with a multiplicity of functions communicating with the various functions within the laser module concept.

J) means to communicate with other functions which may me added to the general concept thereby making the concept infinitely flexible and not subject to obsolescence.

The laser module (12) provides a source for either visible or invisible radiation coupled to mechanical adjustments further coupled to optics to focus the output of the laser device at various distances through infinity. The optics may be general optics consisting of the various types of lenses and including but not limited to a graded index lens. The laser module (12) has electrical connections that communicate with the timer controller or the multiplicity of microprocessors and microcontrollers.

The piezo module sensor functions to initiate a series of electronic events which terminates in the activation of the laser module (12). The piezo module (16) contains a buffer block communicating with the pistol firing pin (24E). The buffer block upon impact from the pistol firing pin (24E) initiates the discharge of a cartridge communicating with a disc coupled to a spring like material further coupled to a piezo electric crystal. The piezo electric crystal has electrical connections which communicate with the signal conditioner.

The piezo sensor mechanism may also be a switch coupled to any mechanism which is used to initiate the firing of a cartridge or coupled to such other mechanism that is to be sensed as being in the process of initiating the firing of a cartridge. In its most simplistic form, the switch consists of two open or closed electrical contacts having electrical connections which communicate with the power source and the other components of the laser module (12). The sensor switch may also be a more complex configuration having proximity and/or motion sensing devices which sense the position or motion of the pistol firing trigger (24F) and/or the pistol firing trigger (24F). The sensor would have electrical connections that would communicate with the power module (18) and other components of the retrofittable laser system (10).

It will be understood that each of the elements described above, or two or more together, may also find a useful application in other types of constructions differing from the type described above.

While the invention has been illustrated and described as embodied in a retrofittable laser system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A retrofittable laser system (10) utilizing miniaturized components which are insertable into a firearm barrel (24B) of a firearm (24) which emits a laser module light pulse (12C) when a firearm firing trigger (24F) activates a firearm firing pin (24E), the firearm (24) further comprises a firearm housing (24A) and a firearm ammunition chamber (24D), the retrofittable laser system (10) is insertable into a retrofittable housing (11) and held in position at opposite distal ends by at least two retrofittable housing rings (11B), the retrofittable laser system (10) comprising:

A) a laser module (12) which comprises:

i) at least one laser module pin (12A), ii) a laser module diode (12E) having a laser module diode driver circuit (12EA) electronically connected to the at least one laser module pin (12A), and iii) a laser module graded index optics (12D) integrally associated with the laser module diode (12E);

B) a processor module (14) which comprises at least one module pin receptacle which is complimentary to the at least one laser module pin (12A) forming an electrical connection when inserted therein and at least one processor module pin, the processor module (14) further comprises a first processor module (14A) having at least one first processor module pin receptacle (14AB) and at least one first processor module pin (14AA) which is electronically insertably connectable to at least one first power module electronic connector pin receptacle (18AB) of a first power module (18A);

C) a piezo module (16) which comprises at least one piezo module pin receptacle (16B) which is complimentary to the at least one processor module pin forming an electrical connection when inserted therein and at least one piezo module pin (16A) and a piezo module switch (16D) which is activatable when hit by the firearm firing pin (24E);

D) a power module (18) which comprises at least one power module electronic connector pin receptacle which is complimentary to the at least one piezo module pin (16A)forming an electrical connection when inserted therein, the retrofittable housing (11) has at least one retrofittable housing groove (11A) which is complimentary to at least one laser module ridge (12B) extending from the laser module (12), the first power module (18A) further comprises at least one first power module electronic connector pin (18AA) which is electronically insertably connectable into at least one first cable/connector power module adaptor pin receptacle (22AAA) of a first cable/connector power module adaptor (22AA) of a first cable/connector (22A) which further comprises a first cable/connector piezo module adaptor (22AB) which comprises at least one first cable/connector piezo module adaptor pin (22ABA) which is complimentary to and insertable within the at least one piezo module pin receptacle (16B) forming an electronic connection therebetween, at least one processor module ridge extends from the processor module (14), the first power module (18A) further comprises a second power module (18B) which comprises at least one second power module electronic connector pin (18BA) which is which is electronically insertably connectable into at least one second cable/connector first power module adaptor pin receptacle (22BAA) of a second cable/connector first power module adaptor (22BA) of a second cable/connector (22B), at least one second cable/connector second power module adaptor pin receptacle (22BBA) of a second cable/connector second power module adaptor (22BB) is electronically insertably connectable into at least one first power module electronic connector pin (18AA) of the first power module (18A), the second cable/connector (22B) further comprises at least one second cable/connector piezo module adaptor pin (22BCA) of a second cable/connector piezo module adaptor (22BC) which is electronically insertably connectable into at least one piezo module pin receptacle (16B), at least one cable/connector line (22D) electronically connects the at least one first cable/connector power module adaptor pin receptacle (22AAA) and the at least one first cable/connector piezo module adaptor pin (22ABA) the at least one second cable/connector first power module adaptor pin receptacle and the at least one second cable/connector piezo module adaptor pin together, at least one piezo module ridge (16C) extending from the piezo module (16), and at least one first power module electronic ridge (18AC) extending from the power module (18); and E) at least one recoil module (20) which comprises a gas cylinder (25) removably insertable into an ammunition magazine gas cylinder chamber having an ammunition magazine gas cylinder chamber cap removably mounted thereon, the ammunition magazine gas cylinder chamber cap further comprises a pistol ammunition magazine gas cylinder chamber cap point thereon which functions to pierce the gas cylinder (25) permitting pressurized gas to escape therefrom into the ammunition magazine gas cylinder chamber, the at least one recoil module (20) further comprises a ammunition magazine gas pre-chamber pneumatically connected to the ammunition magazine gas cylinder chamber having an ammunition magazine gas pre-chamber first switch therebetween which functions to allow a pre determined amount of pressurized gas to be released and expand in the ammunition magazine gas pre-chamber, the at least one recoil module (20) further comprises an ammunition magazine gas expansion chamber pneumatically connected to the ammunition magazine gas pre-chamber having an ammunition magazine gas pre-chamber second switch therebetween which functions to release pressurized gas from the ammunition magazine gas pre-chamber to the ammunition magazine gas expansion chamber simultaneously with emission of the laser module light pulse (12C), an ammunition magazine gas expansion chamber anvil is positioned within the ammunition magazine gas expansion chamber at a resting position adjacent to the pneumatic connection, the ammunition magazine gas expansion chamber anvil is securely fastened at a first distal end to an ammunition magazine gas expansion chamber return means and securely fastened at a second distal end to an ammunition magazine gas expansion chamber stopper, when a user pulls the firearm firing trigger (24F), the firearm firing pin (24E) is released hitting a piezo module switch (16D) which opens the ammunition magazine gas pre-chamber second switch releasing pressurized gas into ammunition magazine gas expansion chamber expanding therein forcing the ammunition magazine gas expansion chamber anvil to strike the ammunition magazine gas expansion chamber stopper simulating recoil, the expanded gas then escapes from an ammunition magazine gas expansion chamber port while the ammunition magazine gas expansion chamber anvil returns to the resting position by the ammunition magazine gas expansion chamber return means, the recoil module (20) is housed within an ammunition magazine, the power module (18) further comprises a power module spacer (18C) which comprises at least one power module spacer pin (18CA) electronically connectably insertable into the at least one second cable/connector first power module adaptor pin receptacle (22BAA) and at least one power module spacer pin receptacle (18CB) within which at least one piezo module pin (16A) is insertable therein.

2. The retrofittable laser system (10) as described in claim 1, wherein the laser module (12) further comprises a laser module focus adjustment (12F).

3. The retrofittable laser system (10) as described in claim 1, wherein the fire arm (24) is selected from a group consisting of pistol (124), machine gun (224), sub-machine gun, shotgun (324), rifle, and revolver.

4. The retrofittable laser system (10) as described in claim 1, wherein at least one power module (18) is housed within an ammunition magazine.

5. The retrofittable laser system (10) as described in claim 1, wherein the firearm barrel assembly and magazine are colored in a highly visible color.

6. The retrofittable laser system (10) as described in claim 5, wherein the highly visible color is "safety" orange.

7. The retrofittable laser system (10) as described in claim 5, wherein the a simulator fire barrel assembly has warning labels and the precautions thereto as to the type of laser module (12) therein.

8. The retrofittable laser system (10) as described in claim 1, wherein the retrofittable laser system (10) firearm barrel and retrofittable laser system (10) ammunition magazine are designed to prevent introduction of live ammunition into a breech.

9. The retrofittable laser system (10) as described in claim 1, wherein the processor module (14) controls microcontroller processing of mechanical and electrical functions and storage of these parameters in solid state memory.

10. The retrofittable laser system (10) as described in claim 9, wherein the processor module (14) controls pulse code and frequency modulation of the laser module (12).

11. The retrofittable laser system (10) as described in claim 9, wherein the processor module (14) controls coding of the laser module (12) and transmiting a plurality of different coded laser module light pulses (12C).

12. The retrofittable laser system (10) as described in claim 1, wherein the piezo module (16) comprises a switching means whereby an impact block is coupled to a generally spherical shaped ball further coupled to a spring which is further coupled to the piezo module switch (16D) having electrical outputs communicating with the firearm firing trigger (24F) and power module (18) and processor module (14).

13. The retrofittable laser system (10) as described in claim 12, wherein the piezo module switch (16D) comprises an electrical switch communicating with the firearm firing trigger (24F).

14. The retrofittable laser system (10) as described in claim 13, wherein the piezo module switch (16D) is contained in the simulator firearm barrel of the retrofittable laser system (10).

* * * * *